US012194518B1

(12) United States Patent
He et al.

(10) Patent No.: US 12,194,518 B1
(45) Date of Patent: Jan. 14, 2025

(54) VIBRATION SUPPRESSION METHOD AND SYSTEM OF A ROLLING MILL ROLLER ASSEMBLY BASED ON A VIBRATION DAMPING DEVICE

(71) Applicant: TAIYUAN UNIVERSITY OF TECHNOLOGY, Taiyuan (CN)

(72) Inventors: Dongping He, Taiyuan (CN); Yiping Wang, Taiyuan (CN); Huidong Xu, Taiyuan (CN); Yuanming Liu, Taiyuan (CN); Tao Wang, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 18/762,421

(22) Filed: Jul. 2, 2024

(30) Foreign Application Priority Data

Jul. 11, 2023 (CN) ..... 202310840903.X

(51) Int. Cl.
*B21B 37/00* (2006.01)

(52) U.S. Cl.
CPC ..... *B21B 37/007* (2013.01)

(58) Field of Classification Search
CPC ..... B21B 37/007; B21B 37/46; B21B 38/008; B21B 2203/44
See application file for complete search history.

(56) References Cited

U.S. PATENT DOCUMENTS 5,961,899 A 10/1999 Rossetti et al.
2015/0047404 A1* 2/2015 De Luca ..... F15B 21/008 72/245

(Continued)

FOREIGN PATENT DOCUMENTS

CN 102755995 A 10/2012
CN 104942010 A 9/2015

(Continued)

OTHER PUBLICATIONS

Liu Bin; Wang Yinghui; Jiang Jialei; Liu Shuang; Research on Time Delay Feedback of Roll System Based on Vibration Absorber Control, Acta Metrologica Sinica, vol. 41, No. 07, Jul. 28, 2020, pp. 842-847.

(Continued)

*Primary Examiner* — Mohammed S. Alawadi

(57) ABSTRACT

A vibration suppression method and system of a rolling mill roller assembly based on a vibration damping device are provided. The vibration suppression method includes: obtaining a first amplitude-frequency relationship during a vibration process of a rolling mill roller assembly vibration suppression system; based on the first amplitude-frequency relationship, determining two time domain relationships and two second amplitude-frequency relationships by a simulation analysis; based on the two time domain relationships and two second amplitude-frequency relationships, adjusting parameters of the vibration damping device until a vibration displacement of the rolling mill roller assembly vibration suppression system is less than or equal to a vibration displacement threshold. And provides a new solution for the stability control of the rolling mill, and ensures the reliability and stability of the vibration suppression of the rolling mill.

5 Claims, 13 Drawing Sheets

(56) References Cited

U.S. PATENT DOCUMENTS

| | | | | |
|---|---|---|---|---|
| 2016/0318083 | A1* | 11/2016 | Del Tedesco | B21B 38/008 |
| 2018/0290191 | A1* | 10/2018 | Krueger | B21B 37/007 |

FOREIGN PATENT DOCUMENTS

| | | | |
|---|---|---|---|
| CN | 106734194 | A | 5/2017 |
| CN | 107009866 | A | 8/2017 |
| CN | 107185966 | A | 9/2017 |
| CN | 109249311 | A | 1/2019 |
| CN | 109465747 | A | 3/2019 |
| CN | 114673752 | A | 6/2022 |
| CN | 115419792 | A | 12/2022 |
| CN | 115672994 | A | 2/2023 |
| JP | H09174115 | A | 7/1997 |
| JP | 2008212974 | A | 9/2008 |
| JP | 2015188891 | A | 11/2015 |
| RU | 88087 | U1 | 10/2009 |
| WO | 2020224231 | A1 | 11/2020 |

OTHER PUBLICATIONS

Liu Haoran; Liu Fei; Peng Rongrong; Zhu Yue Hou Dongxiao; Nonlinear vibration characteristics of strip rolling mill under work piece hysteretic deformation, Journal of Yanshan University, vol. 37, No. 03, May 31, 2013, pp. 240-244.

Wang Ming et al., Vibration Reduction Characteristics of a Rolling Mill Roll System with Particle Damping Vibration Absorber, Journal of Vibration and Shock , vol. 42, No. 2, Jan. 19, 2023, pp. 23-33.

Ming Wang et al., Design of a damped vibration absorber to control the resonant vibration of roll, Mechanical Systems and Signal Processing, Mar. 13, 2022, pp. 1-24.

HE Dongping et al., Nonlinear Vertical Vibration Control Of Corrugated Rolling Mill Based On Particle Damping Absorber, Iron & Steel, Jun. 12, 2023, pp. 1-10.

* cited by examiner

VIBRATION SUPPRESSION METHOD AND SYSTEM OF A ROLLING MILL ROLLER ASSEMBLY BASED ON A VIBRATION DAMPING DEVICE

CROSS REFERENCE TO RELATED APPLICATIONS

This application claims foreign priority of Chinese Patent Application No. 202310840903.X, filed on Jul. 11, 2023 in the China National Intellectual Property Administration, the disclosures of all of which are hereby incorporated by reference.

TECHNICAL FIELD

This application relates to the technical field of vibration suppression of rolling mill, in particular to a vibration suppression method and system of a rolling mill roller assembly based on a vibration damping device.

BACKGROUND

Plate-strip rolling mill plays an important role in the field of heavy industry machinery. With the rapid development of science and technology, the requirements of strip mill in high-end field are getting higher and higher. However, the vibration of the rolling mill often occurs in the working process, which affects the quality and production efficiency of rolling products. It is difficult to meet the requirements of the rolling products in the high-end field. When the vibration is serious, it will damage the rolling equipment, causing economic losses, which limits the rapid development of the rolling industry.

At present, the action of mutually exclusive magnetic force is used to suppress the vibration of the rolling mill roller, or the damping force generated by the damping liquid flow is different through the different diameter of different solenoid valves, so as to realize the vibration reduction of the unit for different frequencies of the mill.

However, the method mentioned above for suppressing the vibration of the roll is passive vibration reduction method, which can only eliminate the high frequency vibration of the rolling mill roller, but can not eliminate the low frequency vibration and irregular vibration, and can not guarantee the reliability and stability of the vibration suppression of the rolling mill roller.

SUMMARY

This application provides a vibration suppression method and system of a rolling mill roller assembly based on a vibration damping device, to solve the technical problem that the existed passive vibration reduction method can only eliminate the high frequency vibration of the rolling mill roller, but can not eliminate the low frequency vibration and irregular vibration, and can not guarantee the reliability and stability of the vibration suppression of the rolling mill roller.

To realize the above objective, the present disclosure provides a vibration suppression method of a rolling mill roller assembly based on a vibration damping device, including:

S1: obtaining a first amplitude-frequency relationship during a vibration process of a rolling mill roller assembly vibration suppression system;

S2: based on the first amplitude-frequency relationship, determining two time domain relationships and two second amplitude-frequency relationships by a simulation analysis;

S3: based on the two time domain relationships and two second amplitude-frequency relationships, adjusting parameters of the vibration damping device until a vibration displacement of the rolling mill roller assembly vibration suppression system is less than or equal to a vibration displacement threshold.

The embodiments of the present application provides a vibration suppression method of a rolling mill roller assembly based on a vibration damping device, obtaining a first amplitude-frequency relationship during a vibration process of a rolling mill roller assembly vibration suppression system; based on the first amplitude-frequency relationship, determining two time domain relationships and two second amplitude-frequency relationships by a simulation analysis; based on the two time domain relationships and two second amplitude-frequency relationships, adjusting parameters of the vibration damping device until a vibration displacement of the rolling mill roller assembly vibration suppression system is less than or equal to a vibration displacement threshold. The present application obtains the first frequency amplitude relationship of the rolling gear vibration suppression system in the vibration amplitude process and adjusts the relevant parameter until the vibration displacement of the rolling gear is less than or equal to the preset vibration displacement threshold value. The present application obtains the interactive relationship between the vibration damping device and the rolling mill roll system through the time domain characteristics and amplitude frequency characteristics, appropriately adjusts the relevant parameters of the vibration reducing device to reduce the high frequency band, low frequency band and irregular vibration displacement of the rolling mill, provides a new solution for the stability control of the rolling mill, and ensures the reliability and stability of the vibration suppression of the rolling mill.

In another embodiment, S1 includes the following steps:

S11: establishing a simplified model corresponding to the rolling mill roller assembly vibration suppression system; wherein the vibration damping device is a kind of passive vibration damping device that connects a magnetorheological (MR) damper to an end of a rolling mill of a rolling mill roller assembly through sleeves and a bearing, and then connects a mass block to the MR damper through an elastic element and a damping element, after the vibration damping device is installed on the rolling mill roller assembly, a freedom system with two degrees is formed;

S12: calculating a corresponding relationship of the freedom system with two degrees of the rolling mill roller assembly vibration suppression system based on the simplified model;

S13: performing a data processing to the freedom system with two degrees by a multiscale method, to obtain the first amplitude-frequency relationship.

In another embodiment, S3 includes the following steps:

S31: determining a corresponding relationship between the parameters of the vibration damping device and the two second amplitude-frequency relationships by the simulation analysis;

S32: based on the two time domain relationships and the corresponding relationship between the parameters of the vibration damping device and the two second amplitude-frequency relationship, adjusting parameters of the vibration damping device until a vibration displacement of the rolling mill roller assembly vibration suppression system is less than or equal to a vibration displacement threshold; wherein the parameters of the vibration damping device includes an initial damping force and damping force adjustable multiplying powers of the MR damper of the vibration damping device, a damping force and an inherent time delay of the passive damper of the damping deviceS31: determining a corresponding relationship between the parameters of the vibration damping device and the two second amplitude-frequency relationships by the simulation analysis;

S32: based on the two time domain relationships and the corresponding relationship between the parameters of the vibration damping device and the two second amplitude-frequency relationship, adjusting parameters of the vibration damping device until a vibration displacement of the rolling mill roller assembly vibration suppression system is less than or equal to a vibration displacement threshold; wherein the parameters of the vibration damping device includes an initial damping force and damping force adjustable multiplying powers of the MR damper of the vibration damping device, a damping force and an inherent time delay of the passive damper of the damping device.

In another embodiment, the S12 includes:

S12 includes following steps:

S121: obtaining an equivalent mass of a lower rolling mill roller assembly, an equivalent mass of the mass block of a passive damper corresponding to the vibration damping device, and an equivalent damping between the lower rolling mill roller assembly and a rolling piece, and an equivalent linear stiffness, and an equivalent nonlinear stiffness, and an equivalent damping and an equivalent stiffness of the lower rolling mill roller assembly and the passive damper;

S122: calculating a corresponding relationship of the freedom system with two degrees of the rolling mill roller assembly vibration suppression system based on the equivalent mass of a lower rolling mill roller assembly, the equivalent mass of the mass block of the passive damper, and the equivalent damping between the lower rolling mill roller assembly and the rolling piece, and the equivalent linear stiffness, and the equivalent nonlinear stiffness, and the equivalent damping and the equivalent stiffness of the lower rolling mill roller assembly and the passive damper.

In another embodiment, the the corresponding relationship of the freedom system with two degrees includes:

$$\begin{cases} m_1\ddot{x}_1 + c_1\dot{x}_1 + c_2(\dot{x}_1 - \dot{x}_2) + k_1x_1 + k_1'x_1^3 + k_2(x_1 - x_2) + P\cdot D^p(x_{1\tau} - x_{2\tau}) - F\cos(\omega t) = 0 \\ m_2\ddot{x}_2 - c_2(\dot{x}_1 - \dot{x}_2) + c_3x_2 - k_2(x_1 - x_2) + k_3x_2 - P\cdot D^p(x_{1\tau} - x_{2\tau}) = 0 \end{cases};$$

wherein, $m_1$ is the equivalent mass of a lower rolling mill roller assembly, $m_2$ is the equivalent mass of the mass block of the passive damper, and $c_1$ is the equivalent damping between the lower rolling mill roller assembly and the rolling piece, and $k_1$ is the equivalent linear stiffness, and $k_1'$ is the equivalent nonlinear stiffness, and $c_2$ is the equivalent damping of the lower rolling mill roller assembly and the passive damper, and $k_2$ is the equivalent stiffness of the lower rolling mill roller assembly and the passive damper, $F\cos(\omega t)$ is a periodic external excitation that the rolling mill is subjected; $P\cdot D^p(x_{1\tau}-x_{2\tau})$ is an equivalent damping force of the MR damper of vibration the damping device between the lower rolling mill roller assembly and the passive damper; $c_3$ is an equivalent damping between the passive damper and a rolling mill stand of the lower rolling mill roller assembly, and $k_3$ is the equivalent stiffness of the passive damper and the rolling mill stand of the lower rolling mill roller assembly.

In another embodiment, S13 includes the following steps:

S131: simplifying the corresponding relationship of the freedom system with two degrees to obtain a simplified corresponding relationship of the freedom system with two degrees;

S132: based on the initial damping force and the damping force adjustable multiplying powers, determining simplified equivalent damping force expressions of the MR damper;

S133: based on the simplified equivalent damping force expressions of the MR damper and corresponding relationship of a current freedom system with two degrees, performing the data processing to the freedom system with two degrees by a multiscale method, to obtain the first amplitude-frequency relationship.

In another embodiment, the corresponding relationship of the freedom system with two degrees includes:

$$\begin{cases} \ddot{x}_1 + \omega_{10}^2x_1 = -\alpha_1\dot{x}_1 - \beta_1(\dot{x}_1 - \dot{x}_2) + \gamma_1x_2 - \mu_1x_1^3 - F_1D^p(x_{1\tau} - x_{2\tau}) + F_0\cos(\omega t) \\ \ddot{x}_2 + \omega_{20}^2x_2 = \beta_2(\dot{x}_1 - 2\dot{x}_2) + \gamma_2x_1 + F_2D^p(x_{1\tau} - x_{2\tau}) \end{cases};$$

wherein, $$\omega_{10} = \sqrt{\frac{k_1 + k_2}{m_1}},\ \omega_{20} = \sqrt{\frac{2k_2}{m_2}},\ \alpha_1 = \frac{c_1}{m_1},\ \beta_1 = \frac{c_2}{m_1},\ \beta_2 = \frac{c_2}{m_2},$$

$$\gamma_1 = \frac{k_2}{m_1},\ \gamma_2 = \frac{k_2}{m_2},\ \mu_1 = \frac{k_1'}{m_1},\ F_1 = \frac{P}{m_1},\ F_2 = \frac{P}{m_2},\ F_0 = \frac{F}{m_1};$$

the simplified equivalent damping force expressions of the MR damper includes:

$$\begin{cases} F_1\cdot D^p(x_{2\tau}) = \eta_1\rho_1D^p(x_{1\tau} - x_{2\tau}) \\ F_2\cdot D^p(x_{2\tau}) = \eta_2\rho_2D^p(x_{1\tau} - x_{2\tau}) \end{cases};$$

wherein, $\eta_1$ and $\eta_2$ are initial damping force coefficients of the MR damper, $\rho_1$ and $\rho_2$ are damping force adjustable multiplying powers of the MR damper;

the two second amplitude-frequency relationship includes:

$$\left(\frac{\eta_1\rho_1\omega_{10}^p a\cos\left(\frac{p\pi}{2}\right)e^{-i\omega_{10}\tau}}{2}-\omega_{10}a\sigma+\frac{3\mu_1 a^3}{8}\right)^2+\left(\frac{\eta_1\rho_1\omega_{10}^p a\sin\left(\frac{p\pi}{2}\right)e^{-i\omega_{10}\tau}}{2}+\frac{\alpha_1\omega_{10}a}{2}+\frac{\beta_1\omega_{10}a}{2}\right)^2=\frac{F_0^2}{4};$$

the present application also provides a vibration suppression system of a rolling mill roller assembly based on a vibration damping device, the vibration suppression system includes:

a controlling equipment, a vibration damping device being connected to the controlling equipment, and a rolling mill roller assembly being connected to the vibration damping device;

the controlling equipment is configured to obtain first amplitude-frequency relationship during a vibration process of a rolling mill roller assembly vibration suppression system;

the controlling equipment is also configured to determine two time domain relationships and two second amplitude-frequency relationships by a simulation analysis, based on the first amplitude-frequency relationship;

the controlling equipment is also configured to adjust parameters of the vibration damping device until a vibration displacement of the rolling mill roller assembly vibration suppression system is less than or equal to a vibration displacement threshold, based on the two time domain relationships and two second amplitude-frequency relationships;

wherein the vibration damping device includes a mounting bearing, a MR damper, a passive damper, a supporting rod and a magnetic sucker;

wherein the rolling mill roller assembly includes a rolling mill stand and a rolling mill roller, wherein the rolling mill stand is connected with the magnetic sucker, the rolling mill roller is connected with the supporting rod;

wherein the controlling equipment is connected with the MR damper and the rolling mill roller;

wherein the controlling equipment includes a plurality of acceleration sensors, a first calculation member, and a second calculation member, and a controller; wherein two of the acceleration sensors are connected with each other, and the controller is connected with the MR damper;

wherein the MR damper is configured to determine the vibration displacement of the rolling mill roller through the acceleration sensors;

wherein the MR damper and the passive damper is configured to absorb part of the vibration energy of the rolling mill roller.

The beneficial effect of the rolling mill roller assembly vibration suppression system based on the vibration reduction device provided by the second aspect is the same as the beneficial effect of the vibration suppression method of the rolling roller based on the vibration reduction device described in any possible implementation of the first aspect or the first aspect, which will not be repeated here.

BRIEF DESCRIPTION OF THE DRAWINGS

The drawings illustrated are provided a further understanding of this application and form part of the present application, and the schematic embodiments of the present application and their instructions used to interpret the application and are not intend to limitation this application. In the attached drawings.

LABELS AND DESCRIPTION

Figure 1:
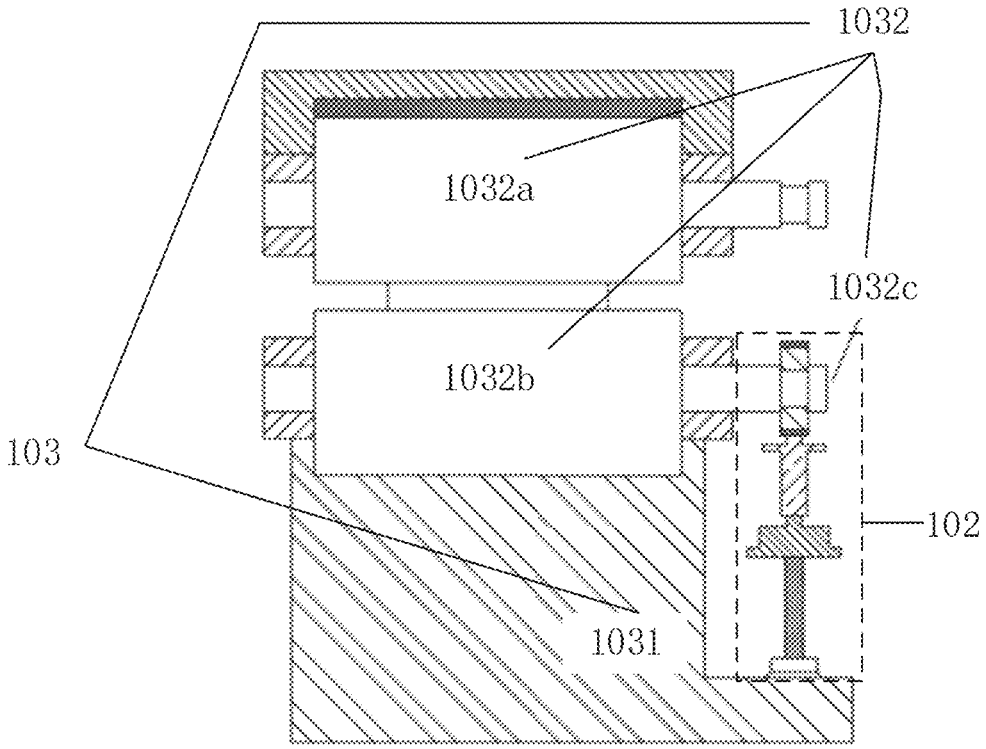
FIG. 1 is a schematic diagram of a vibration suppression system of a rolling mill roller assembly based on a vibration damping device of an embodiment of the present application.

101—a controlling equipment; 102—a vibration damping device; 103—a rolling mill roller assembly; 1031—a rolling mill stand; 1032—a mill roll; 1021—a mounting bearing; 1022—a MR damper; 1023—a passive damper; 1024—a supporting rod; 1025—a magnetic sucker; 1021*a*—a thrust bearing; 1021*b*—a connecting end of the mounting bearing; 1022*a*—an upper connecting end; 1022*b*—a lower connecting end; 1022*c*—a first guiding rod; 1022*d*—a first end cover; 1022*e*—a first sleeve; 1022*f*—a wire barrel; 1022*g*—an envelope; 1022*h*—a first bolt; 1022*i*—a first nut; 1022*j*—a rubber sealing ring; 1023*a*—a second end cover; 1023*b*—a second sleeve; 1023*c*—a connecting end; 1023*d*—a second guiding end; 1023*f*—a mass block; 1023*g*—a second bolt; 1023*h*—a second nut; 1023*i*—a screw; 1011—an acceleration sensor; 1012—a first calculation member; 1013—a second calculation member; 1014—a controller; 1032*a*—a mill roll upper roller; 1032*b*—a mill roll lower roller; 1032*c*—a protrusion of the mill roll lower roller.

DETAILED DESCRIPTION OF THE EMBODIMENTS

In order to facilitate a clear description of the technical solutions of the embodiment of the present application, in the embodiment of the present application, the words "first" and "second" are used to distinguish the same or similar items with basically the same functions and functions. For example, the first and second thresholds are only designed to distinguish between different thresholds and do not define their order. Those skilled in the art can understand that the words "first" and "second" do not limit the number and order of execution, and that the words "first" and "second" are not necessarily different.

It should be noted that in the present application, the words "exemplary" or "for example" are used to represent examples, illustrations or explanations. Any embodiment or design scheme described in this application as "exemplary" or "for example" should not be construed as more preferred or superior over other embodiments or designs. Specifically, the words "exemplary" or "for example" are used to present relevant concepts in a specific way.

In this application, "at least one" means one or more, and "more" means two or more. "And/or", describing the association relationship of the associated object, indicates that there can be three relationships, for example, A and/or B, which can indicate: A alone, A and B together, and B alone, where A and B can be singular or plural. The character "/" generally indicates that the associated object is a relationship of "or". At least one of the following item(s) or its similar expression means any combination of these items, including any combination of individual item(s) or plural item(s). For example, at least one term in a, b or c can indicate the combination of a, b, c, a and b, combination of a and c, combination of b and c, or combination of a, b and c, where a, b, c can be single or multiple.

MR damper is a semi-active execution device based on MR effect. It has the advantages of low energy consumption, fast response speed, simple structure and continuously adjustable damping force. MR damper is an ideal device for semi-automatic control and is widely used in various vibration and shock control systems. At the same time, passive dampers such as mass block, particle damping or magnetic effect are widely used in vibration damping system of rolling mill roller, and the active and passive combined vibration reduction method has been fully utilized in automobile, aircraft rotor, robot and other fields. However, has not been applied in rolling mill roller vibration suppression, therefore, the embodiment of this application provides a vibration suppression method of the rolling mill roller assembly based on vibration reduction device thereof, to solve problems of passive vibration reduction method, which can only eliminate the high frequency vibration of the rolling roll roller, but can not eliminate the low frequency vibration and irregular vibration, and can not guarantee the reliability and stability of the vibration suppression of the rolling roll roller.

FIG. 1 is a schematic diagram of a vibration suppression system of a rolling mill roller assembly based on a vibration damping device of an embodiment of the present application, as shown in FIG. 1, the vibration suppression system of a rolling mill roller assembly includes:

a controlling equipment 101, a vibration damping device 102 is connected to the controlling equipment, and a rolling mill roller assembly 103 is connected to the vibration damping device 102.

The controlling equipment 101 is used to the controlling equipment is configured to obtain first amplitude-frequency relationship during a vibration process of a rolling mill roller assembly vibration suppression system; and the controlling equipment is also configured to determine two time domain relationships and two second amplitude-frequency relationships by a simulation analysis, based on the first amplitude-frequency relationship; and the controlling equipment is also configured to adjust parameters of the vibration damping device until a vibration displacement of the rolling mill roller assembly vibration suppression system is less than or equal to a vibration displacement threshold, based on the two time domain relationships and two second amplitude-frequency relationships.

As shown in FIG. 1, the rolling mill roller assembly 103 includes a rolling mill stand 1031 and a rolling mill roller 1032; the rolling mill stand 1031 is connected to the magnetic sucker 1025; the rolling mill roller 1032 and the mounting bearing 1021; and the controlling equipment 101 is connected with the MR damper 1022 and the rolling mill roller 1032.

Specifically, referring to FIG. 1, the rolling mill roller 1032 includes a rolling mill upper roller 1032*a*, a rolling mill lower roller 1032*b*, and a protrusion of the rolling mill roller 1032*c*.

Figure 2:
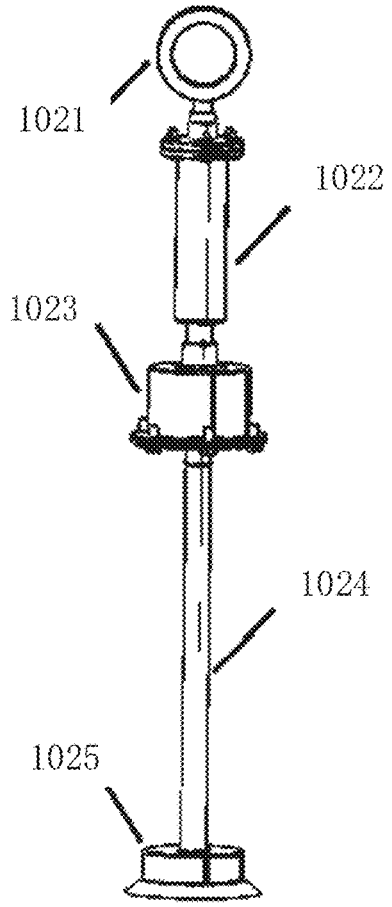
FIG. 2 is a schematic diagram of a vibration damping device of an embodiment of the present application.

FIG. 2 is a schematic diagram of a vibration damping device of an embodiment of the present application, as shown in FIG. 2, The vibration damping device 102 includes a mounting bearing 1021, a MR damper 1022, and a passive damper 1023, and a supporting rod 1024, and a magnetic sucker 1025. An end of the mounting bearing 1021 is provided with an external thread, and the mounting bearing 1021 connects with an upper of the MR damper 1022 by an internal thread fitting connection. A lower end of the MR damper 1022 is provided with an external thread, and is connected with the passive damper 1023 by an external thread fitting connection. An upper cover of the passive damper 1023 is provided with internal thread, and is connected with the supporting rod 1024 by an external thread fitting connection, and another end of the supporting rod 1024 is connected with the magnetic sucker 1025 by internal thread fitting connection.

Figure 3:
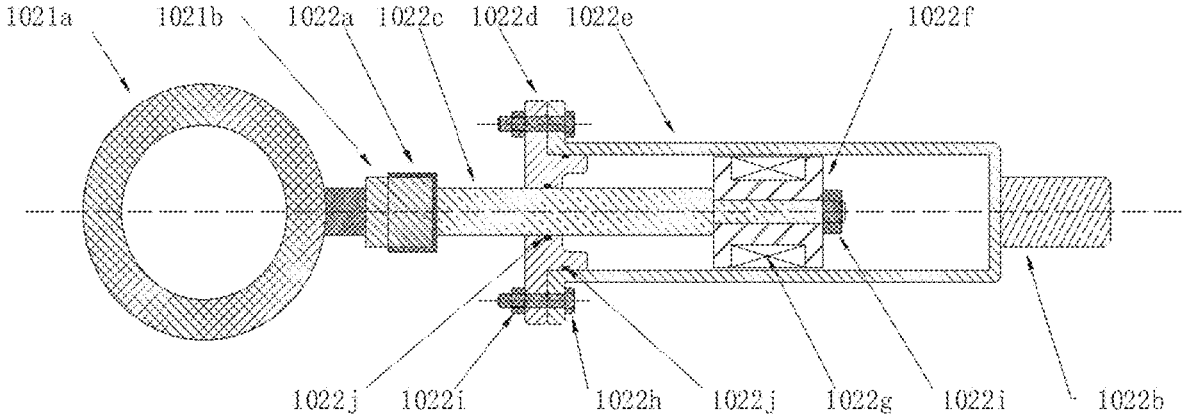
FIG. 3 is a schematic diagram of a MR damper and a mounting bearing of an embodiment of the present application.

FIG. 3 is a schematic diagram of a MR damper and a mounting bearing of an embodiment of the present application. As shown in FIG. 3, the mounting bearing 1021 includes a thrust bearing 1021*a* and a connecting end of the mounting bearing 1021*b*. The MR damper 1022 includes an upper connecting end 1022*a*, lower connecting end 1022*b*, and a first guiding end 1022*c*, and a first end cover 1022*d*, and a first sleeve 1022*e*, and a wire barrel 1022*f*, and an envelope 1022*g*, and a first bolt 1022*h*, and a first nut 1022*i*, and a rubber sealing ring 1022*j*.

Please refers to FIG. 3, the upper connecting end 1022*a* is firmly connected to the first guiding end 1022*c*, the first guiding end 1022*c* passes through a link hole of the first end cover 1022*d*, and the first guiding end 1022*c* is connected to the barrel 1022*f*. A protruding portion is provided on a rod of the first guiding end 1022*c*, and is fix by a nut. The first guiding end 1022*c* and link hole of the first end cover 1022*d* are sealed through a rubber sealing ring, to prevent magnetorheological fluid leakage. A wire hole is defined inside the first guiding end 1022*c*, an envelope 1022*g* connects the controlling equipment through the wire hole. In the MR damper, the envelope 1022*g* is wraped around the barrel 1022*f*. The first sleeve 1022*e* is connected to the first end cover 1022*d* by a bolt and a nut. The first end cap 1022*d* and the first sleeve 1022*e* are sealed by the rubber sealing ring, to prevent magnetorheological fluid leakage. The first sleeve 1022*e* is firmly connected with the lower connecting end 1022*b*.

Figure 4:
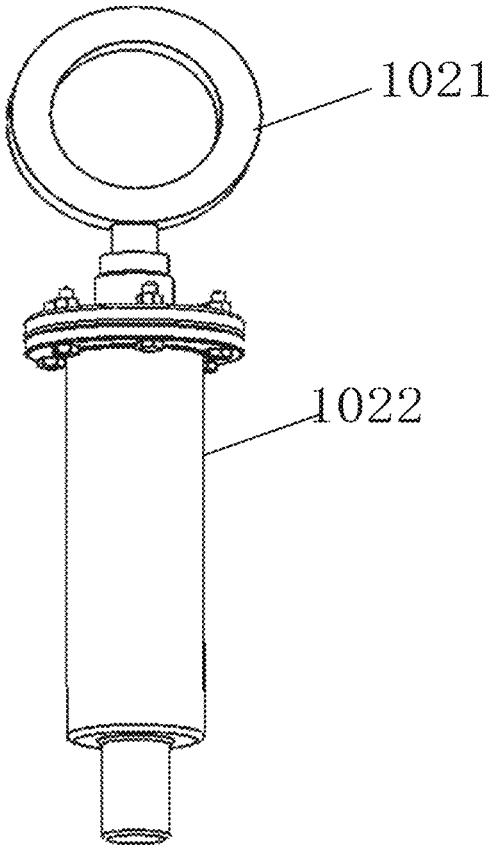
FIG. 4 is a schematic diagram of a MR damper and a mounting bearing of another embodiment of the present application.
Figure 5:
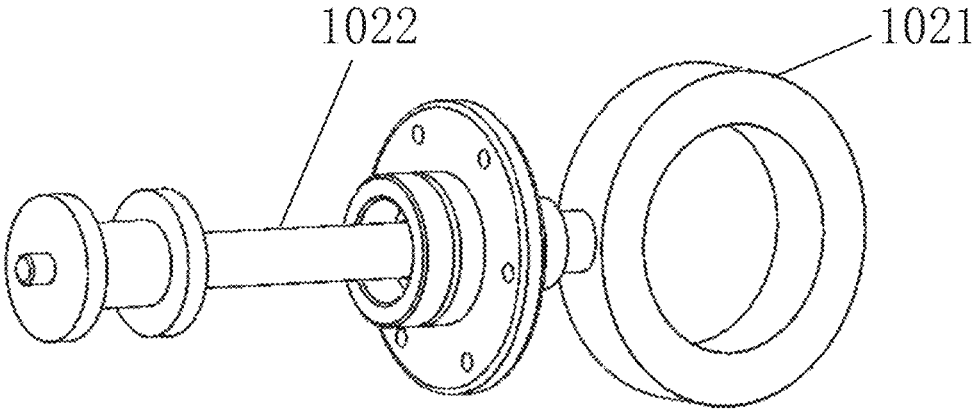
FIG. 5 is a schematic diagram of another view of the MR damper and the mounting bearing of FIG. 4.

FIG. 4 is a schematic diagram of a MR damper and a mounting bearing of another embodiment of the present application, FIG. 5 is a schematic diagram of another view of the MR damper and the mounting bearing of FIG. 4 as shown in FIG. 4 and FIG. 5, the mounting bearing 1021 and the MR damper 1022 are connected.

Figure 6:
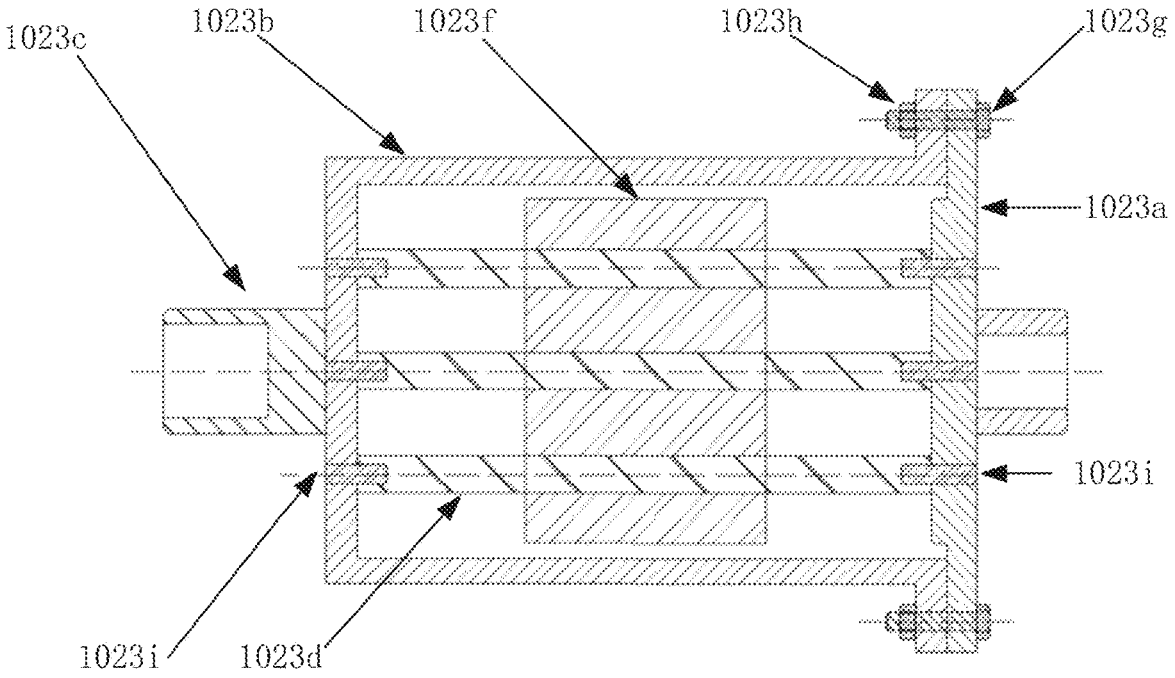
FIG. 6 is a section view of a passive damper of an embodiment of the present application.
Figure 7:
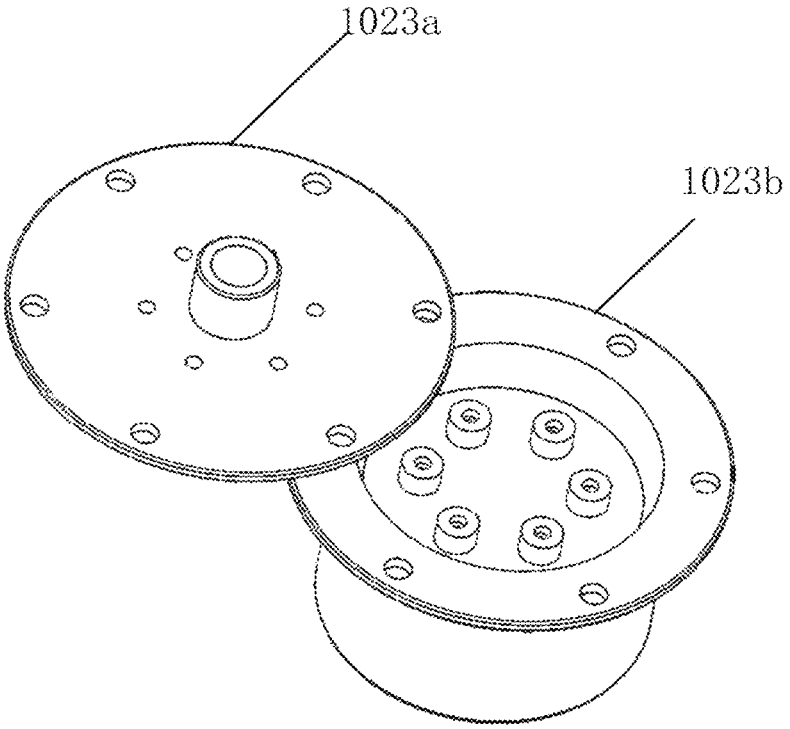
FIG. 7 is a schematic diagram of an second end cover and second sleeve of the passive damper of an embodiment of the present application.

FIG. 6 is a schematic diagram of a passive damper of an embodiment of the present application; FIG. 6 is a schematic diagram of an second end cover and second sleeve of the passive damper of an embodiment of the present application; as shown in FIG. 5A, the passive damper includes a second end cover 1023*a*, and a second sleeve 1023*b*, and a connecting end 1023*c*, and a second guiding end 1023*d*, and a spring (not marked in the figure), and a mass block 1023*f*, and a second bolt 1023*g*, and a second nut 1023*h*, and a screw 1023*i*. An outer center of the second end cover 1023*a* has an inner thread hole. The second end cover 1023*a* has a penetrating screw hole and a second bolt hole. The second sleeve 1023*b* is connected to the second end cover 1023*a* by the second bolt 1023*g* of the second nut 1023*h*. The second sleeve 1023*b* also has a penetrating screw hole. The second guide 1023*d* rod has a non-penetration thread, the second guiding end 1023*d* is connected to a bottom of the second sleeve 1023*b* and the second end cover 1023*a* through the screw 1023*i*. The mass block 1023*f* is defined with a penetration hole, the mass block 1023*f* is inside the passive damper 1023 through the second guiding end 1023*d*. Two ends of the mass block 1023*f* through springs to connect the inner bottom of the second sleeve 1023*b* and a bottom of the second end cover 1023*a* along the second guiding end 1023*d*. The second sleeve 1023*b* is firmly connected to the connecting end 1023*c*. When the roller vibrate vertically, the roller vibration energy is transferred to the passive damper, the passive damper absorbs part of the vibration energy and change into a kinetic energy of the mass block 1023*f* and a potential energy of the spring, thus reducing the vibration displacement of the roller. As shown in FIG. 7, the passive damper includes a second end cover 1023*a* and a second sleeve 1023*b*.

Figure 8:
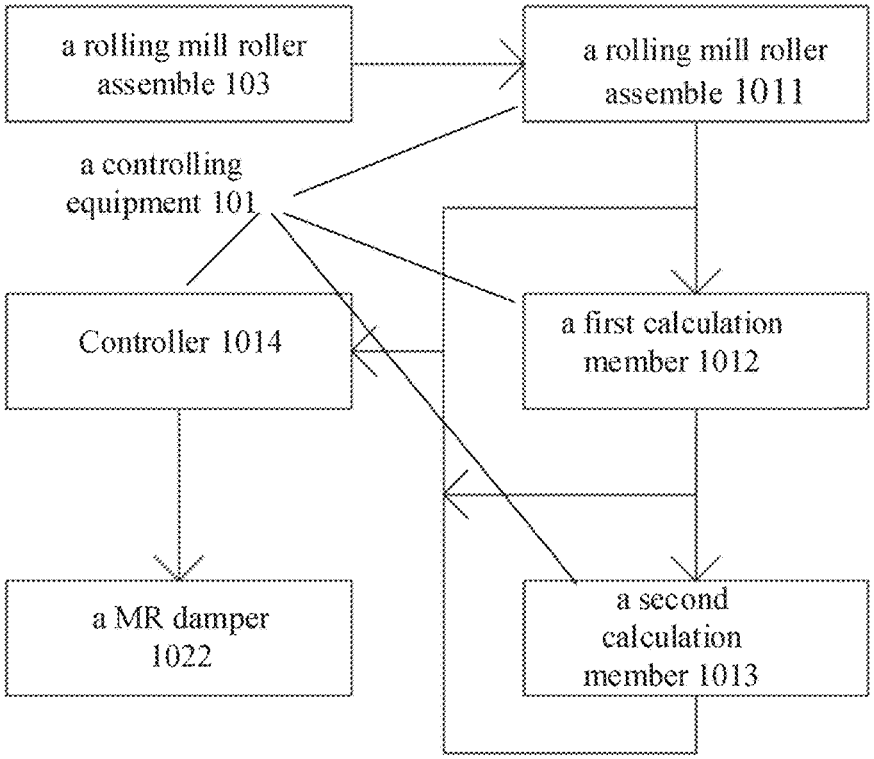
FIG. 8 is another schematic diagram a vibration suppression system of a rolling mill roller assembly based on a vibration damping device of an embodiment of the present application.

FIG. 8 is another schematic diagram a vibration suppression system of a rolling mill roller assembly based on a vibration damping device of an embodiment of the present application. As shown in FIG. 8, the controlling equipment 101 includes a plurality of acceleration sensors 1011, a first calculation member 1012, and a second calculation member 1013, and a controller 1014. Two of the acceleration sensors 1012 are connected with each other, and the controller 1014 is connected with the MR damper 1022. The MR damper 1022 is configured to determine the vibration displacement of the rolling mill roller 1032 through the acceleration sensors 1011. The MR damper 1022 and the passive damper are used to absorb part of the vibration energy of the rolling mill roller 1032.

As shown in FIG. 1 or FIG. 8, the MR damper is connected with controller equipment, measuring the displacement of the outer frame end of the rolling mill through a three-way displacement sensor instead of the roller end displacement. When the displacement exceeds a certain threshold, the controller equipment applies a current to the MR damper. When the vertical vibration of the rolling mill roller exceeds a certain threshold, the vibration energy of the rolling mill roller is transferred to the MR damper, and the magnetorheological fluid of the MR damper may occur electromagnetic reaction, and the viscosity increases and absorbs the vibration displacement of the roller.

Figure 9:
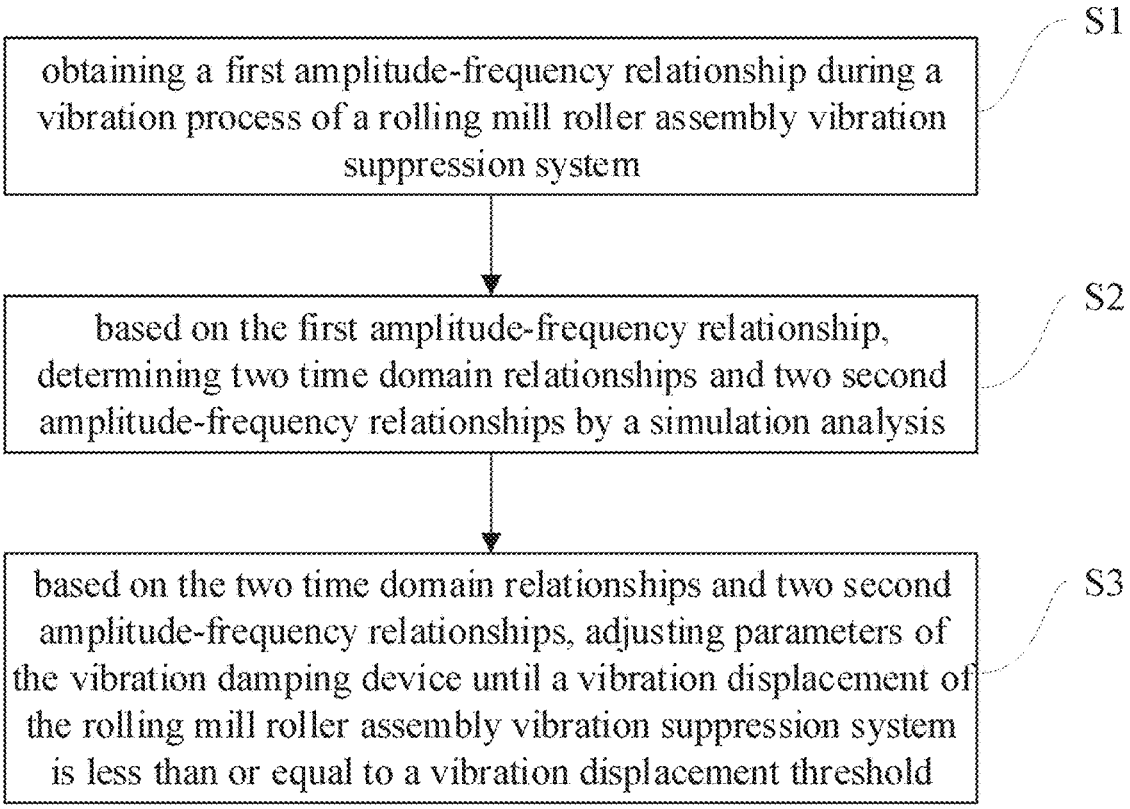
FIG. 9 is a flow chart of a vibration suppression method of a rolling mill roller assembly based on a vibration damping device of an embodiment of the present application.

FIG. 9 is a schematic diagram of a vibration suppression method of a rolling mill roller assembly based on a vibration damping device of an embodiment of the present application. The schematic diagram of a vibration suppression method is applied to the vibration suppression system of the rolling mill roller assembly based on the vibration damping device, a controlling equipment and a rolling mill roller assembly shown in FIGS. 1-8, as shown in FIG. 9, the vibration suppression method includes:

S1: obtaining a first amplitude-frequency relationship during a vibration process of a rolling mill roller assembly vibration suppression system;

S2: based on the first amplitude-frequency relationship, determining two time domain relationships and two second amplitude-frequency relationships by a simulation analysis, wherein the two time domain relationships are corresponding to a working state and a non working state of the rolling mill roller assembly vibration suppression system, and the two second amplitude-frequency relationships are corresponding to the working state and the non working state of the rolling mill roller assembly vibration suppression system;

S3: based on the two time domain relationships and two second amplitude-frequency relationships, adjusting parameters of the vibration damping device until a vibration displacement of the rolling mill roller assembly vibration suppression system is less than or equal to a vibration displacement threshold.

In summary, the present embodiment provides a vibration suppression method of a rolling mill roller assembly based on a vibration damping device, obtaining a first amplitude-frequency relationship during a vibration process of a rolling mill roller assembly vibration suppression system; based on the first amplitude-frequency relationship, determining two time domain relationships and two second amplitude-frequency relationships by a simulation analysis, wherein the two time domain relationships are corresponding to a working state and a non working state of the rolling mill roller assembly vibration suppression system, and the two second amplitude-frequency relationships are corresponding to the working state and the non working state of the rolling mill roller assembly vibration suppression system; based on the two time domain relationships and two second amplitude-frequency relationships, adjusting parameters of the vibration damping device until a vibration displacement of the rolling mill roller assembly vibration suppression system is less than or equal to a vibration displacement threshold. The present application obtains the interactive relationship between the vibration damping device and the rolling mill roll system through the time domain characteristics and amplitude-frequency characteristics, appropriately adjusts the relevant parameters of the vibration reducing device to reduce the high frequency band, low frequency band and irregular vibration displacement of the rolling mill roller assembly, provides a new solution for the stability control of the rolling mill roller assembly, and ensures the reliability and stability of the vibration suppression of the rolling mill roller assembly.

Figure 10:
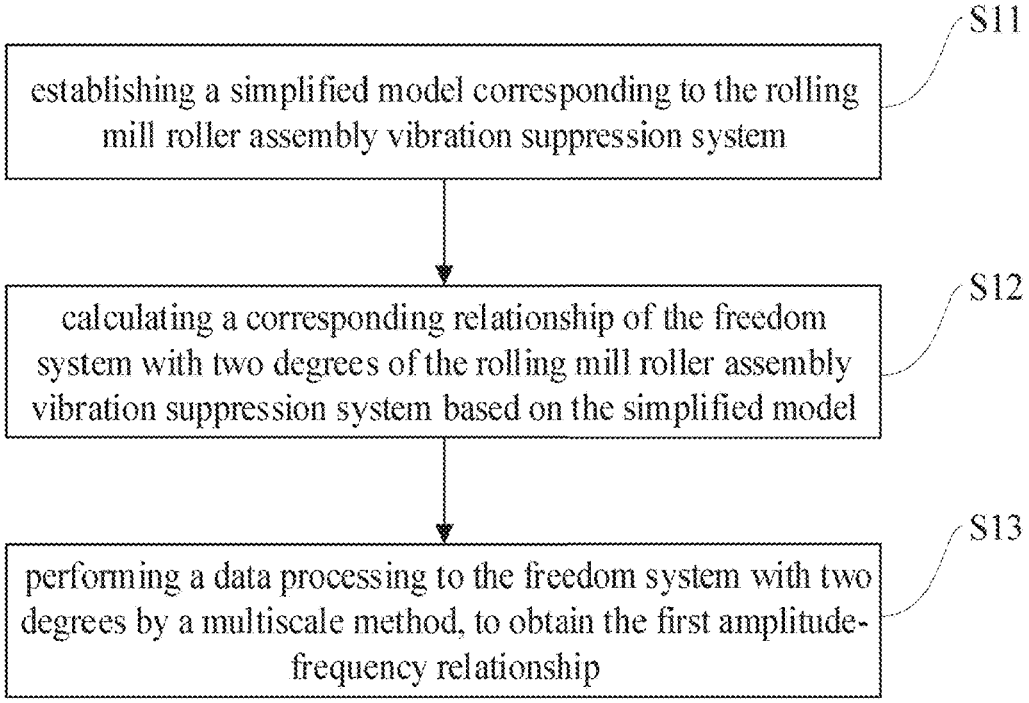
FIG. 10 is a first detailed flowchart of the vibration suppression method of S1 of FIG. 9.

FIG. 10 is a schematic diagram of a vibration suppression method of a rolling mill roller assembly based on a vibration damping device of another embodiment of the present application, applied to a vibration suppression system including a vibration damping device, a controlling equipment, and a rolling mill roller assembly vibration suppression system shown in FIGS. 1-8, as shown in FIG. 10, S1 includes:

S11: establishing a simplified model corresponding to the rolling mill roller assembly vibration suppression system;

In this application, the vibration damping device is a kind of passive vibration damping device that connects a MR damper to an end of a rolling mill of a rolling mill roller assembly through sleeves and a bearing, and then connects a mass block to the MR damper through an elastic element and a damping element, after the vibration damping device is installed on the rolling mill roller assembly, a freedom system with two degrees is formed. In ideal conditions, the rolling mill roller and the vibration damping device only make a straight movement in the vertical direction of the rolling mill roller. When the system is static and the equilibrium position of the damping device is the moving origin, and a value of the vibration displacement of the rolling mill roller and the vibration represents strength. When needs to reduce the vibration of the rolling mill roll train, it needs to reduce the vibration displacement. The rolling mill roller assembly vibrates under the external excitation, and a vibration energy of the rolling mill roll system is transferred to the main and passive combined damper through the electromagnetic reaction of the MR damper. A force of the vibration damping on the rolling mill roller assembly through the MR damper, elastic element and damping element is opposite to the external force on the rolling mill assembly. Thus, the vibration energy of the mill roll system is transferred to the magneticrheological fluid and the kinetic energy of the passive vibration damping device, to reduce the vibration displacement of the rolling mill roller assembly, and to achieve the effect of inhibiting the vibration.

S12: calculating a corresponding relationship of the freedom system with two degrees of the rolling mill roller assembly vibration suppression system based on the simplified model;

S13: process the data of the corresponding relationship of the two degrees of freedom systems and determine the first frequency amplitude relationship.

Figure 11:
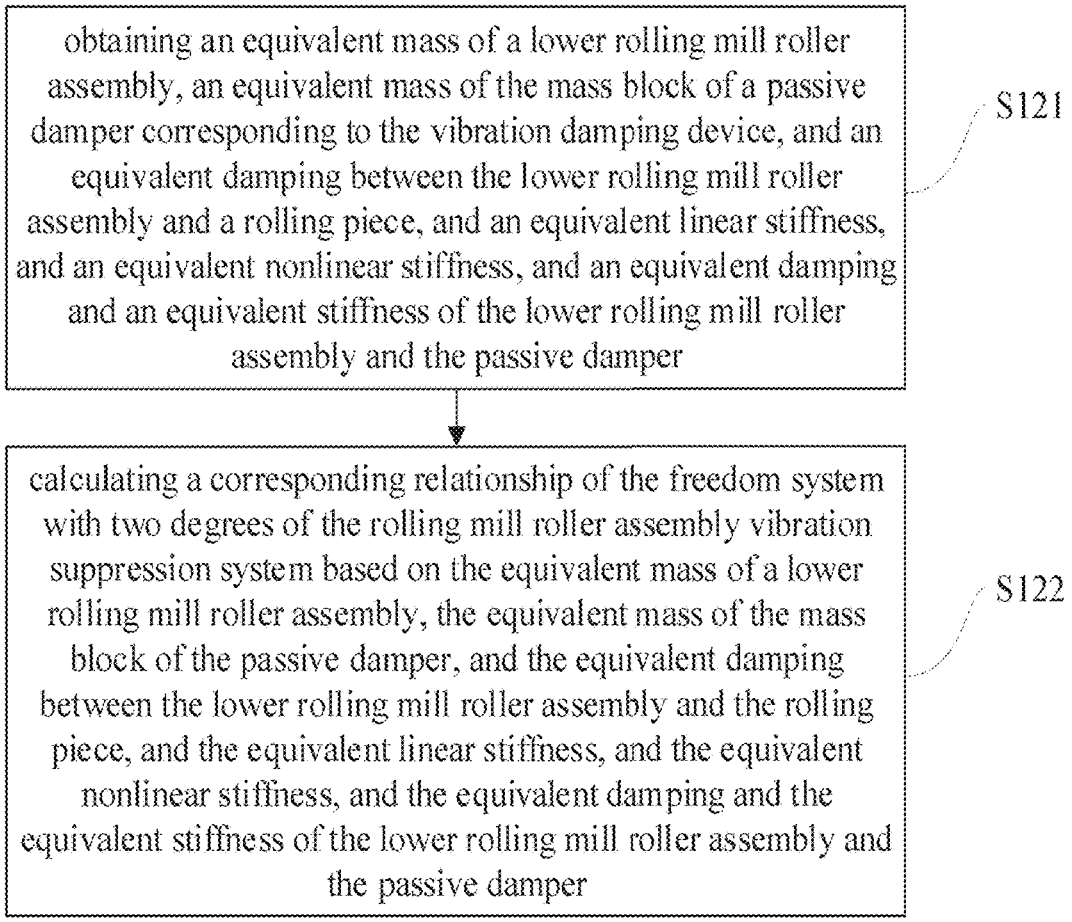
FIG. 11 is a second detailed flowchart of the vibration suppression method S12 of FIG. 10.

As shown in FIG. 11, S12 includes:

S121: obtaining an equivalent mass of a lower rolling mill roller assembly, an equivalent mass of the mass block of a passive damper corresponding to the vibration damping device, and an equivalent damping between the lower rolling mill roller assembly and a rolling piece, and an equivalent linear stiffness, and an equivalent nonlinear stiffness, and an equivalent damping and an equivalent stiffness of the lower rolling mill roller assembly and the passive damper;

S122: calculating a corresponding relationship of the freedom system with two degrees of the rolling mill roller assembly vibration suppression system based on the equivalent mass of a lower rolling mill roller assembly, the equivalent mass of the mass block of the passive damper, and the equivalent damping between the lower rolling mill roller assembly and the rolling piece, and the equivalent linear stiffness, and the equivalent nonlinear stiffness, and the equivalent damping and the equivalent stiffness of the lower rolling mill roller assembly and the passive damper.

Wherein the corresponding relationship of the freedom system with two degrees includes:

$$\begin{cases} m_1\ddot{x}_1 + c_1\dot{x}_1 + c_2(\dot{x}_1 - \dot{x}_2) + k_1x_1 + k_1'x_1^3 + k_2(x_1 - x_2) + P\cdot D^p(x_{1\tau} - x_{2\tau}) - F\cos(\omega t) = 0 \\ m_2\ddot{x}_2 - c_2(\dot{x}_1 - \dot{x}_2) + c_3x_2 - k_2(x_1 - x_2) + k_3x_2 - P\cdot D^p(x_{1\tau} - x_{2\tau}) = 0 \end{cases};$$

Among them, $m_1$ is the equivalent mass of a lower rolling mill roller assembly, $m_2$ is the equivalent mass of the mass block of the passive damper, and $c_1$ is the equivalent damping between the lower rolling mill roller assembly and the rolling piece, and $k_1$ is the equivalent linear stiffness, and $k_1'$ is the equivalent nonlinear stiffness, and $c_2$ is the equivalent damping of the lower rolling mill roller assembly and the passive damper, and $k_2$ is the equivalent stiffness of the lower rolling mill roller assembly and the passive damper, F $\cos(\omega t)$ is a periodic external excitation that the rolling mill is subjected; $P\cdot D^p(x_{1\tau}-x_{2\tau})$ is an equivalent damping force of the MR damper of vibration the damping device between the lower rolling mill roller assembly and the passive damper; $c_3$ is an equivalent damping between the passive damper and a rolling mill stand of the lower rolling mill roller assembly, and $k_3$ is the equivalent stiffness of the passive damper and the rolling mill stand of the lower rolling mill roller assembly.

Figure 12:
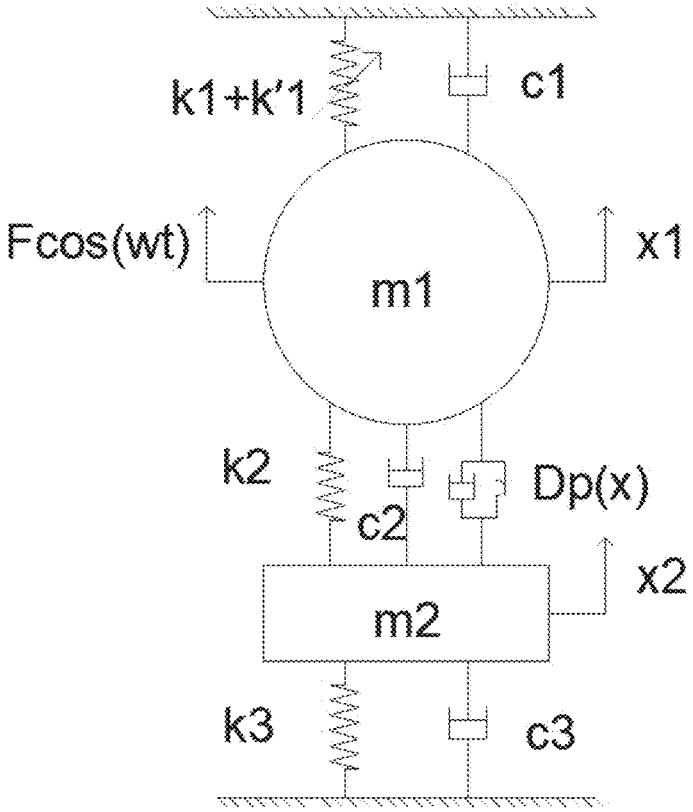
FIG. 12 is a schematic diagram of a simplified model of a vibration suppression method of a rolling mill roller assembly based on a vibration damping device of an embodiment of the present application.

FIG. 12 is a schematic diagram of a simplified model of a vibration suppression method of a rolling mill roller assembly based on a vibration damping device of an embodiment of the present application, as shown in FIG. 12, The For the equivalent mass of the roll line under the rolling mill, For the equivalent mass of the described passive damper mass block, The equivalent damping between the lower roll train and the piece is The equivalent linear stiffness and the equivalent nonlinear stiffness are and, respectively, The equivalent damping between the lower roller train and the passive damper is, The stated equivalent stiffness is defined as, It is approximate that the roll is subject to a periodic external excitation of; For the equivalent damping force of the magnetic rheological damper in the vibration damper between the lower roller train and the passive damper, The equivalent damping between the passive shock absorber and the rolling mill stand is, The equivalent stiffness is, Since the MR dampers belong to the class of active dampers, Mainly through the electromagnetic reaction to achieve the vibration reduction effect, Thus the equivalent quality of the MR damper itself has no effect on the damping effect, Thus, the equivalent mass block of the MR damper should not be reflected in the 2 D model diagram.

Figure 13:
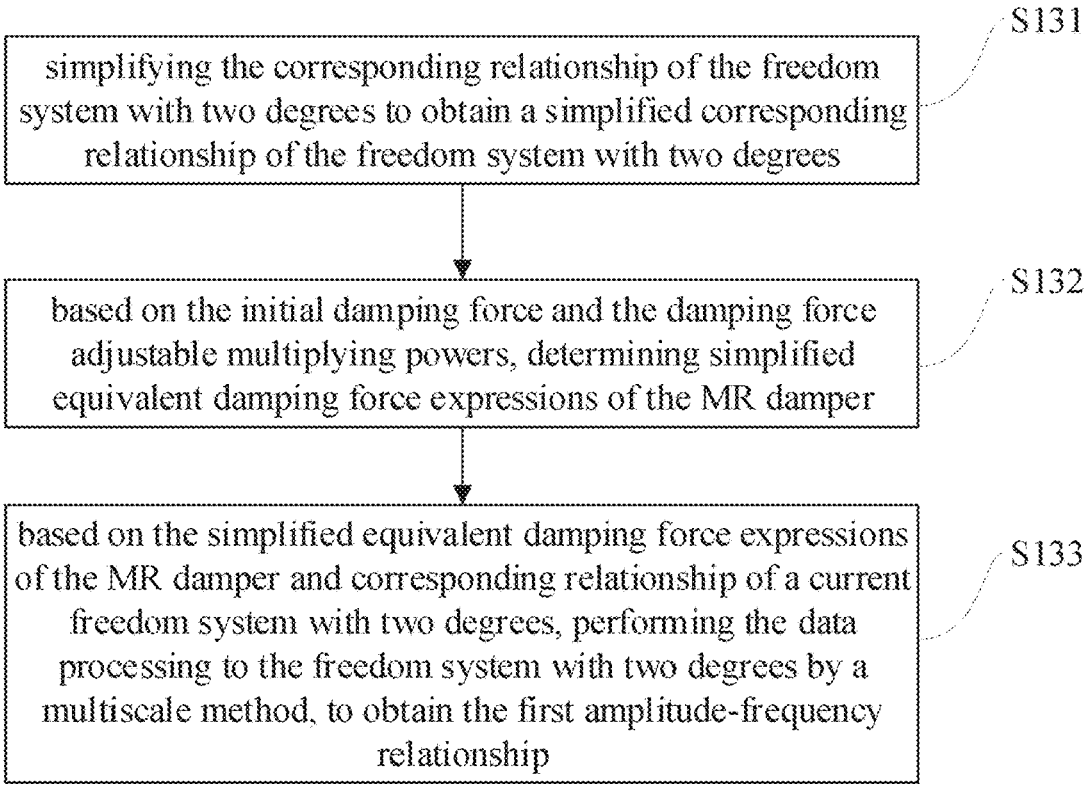
FIG. 13 is a third detailed flowchart of the vibration suppression method of S13 of FIG. 10.

As shown in FIG. 13, S13 includes:

S131: simplifying the corresponding relationship of the freedom system with two degrees to obtain a simplified corresponding relationship of the freedom system with two degrees;

S132: based on the initial damping force and the damping force adjustable multiplying powers, determining simplified equivalent damping force expressions of the MR damper;

S133: based on the simplified equivalent damping force expressions of the MR damper and corresponding relationship of a current freedom system with two degrees, performing the data processing to the freedom system with two degrees by a multiscale method, to obtain the first amplitude-frequency relationship.

Wherein, the corresponding relationship of the simplified freedom system with two degrees:

$$\begin{cases} \ddot{x}_1 + \omega_{10}^2 x_1 = -\alpha_1 \dot{x}_1 - \beta_1(\dot{x}_1 - \dot{x}_2) + \gamma_1 x_2 - \mu_1 x_1^3 - F_1 D^p(x_{1\tau} - x_{2\tau}) + F_0 \cos(\omega t) \\ \ddot{x}_2 + \omega_{20}^2 x_2 = \beta_2(\dot{x}_1 - 2\dot{x}_2) + \gamma_2 x_1 + F_2 D^p(x_{1\tau} - x_{2\tau}) \end{cases};$$

wherein, $$\omega_{10} = \sqrt{\frac{k_1 + k_2}{m_1}},\ \omega_{20} = \sqrt{\frac{2k_2}{m_2}},\ \alpha_1 = \frac{c_1}{m_1},\ \beta_1 = \frac{c_2}{m_1},\ \beta_2 = \frac{c_2}{m_2},$$

$$\gamma_1 = \frac{k_2}{m_1},\ \gamma_2 = \frac{k_2}{m_2},\ \mu_1 = \frac{k_1'}{m_1},\ F_1 = \frac{P}{m_1},\ F_2 = \frac{P}{m_2},\ F_0 = \frac{F}{m_1};$$

the simplified equivalent damping force expressions of the MR damper includes:

$$\begin{cases} F_1 \cdot D^p(x_{2\tau}) = \eta_1 \rho_1 D^p(x_{1\tau} - x_{2\tau}) \\ F_2 \cdot D^p(x_{2\tau}) = \eta_2 \rho_2 D^p(x_{1\tau} - x_{2\tau}) \end{cases};$$

wherein, $\eta_1$ and $\eta_2$ are initial damping force coefficients of the MR damper, $\rho_1$ and $\rho_2$ are damping force adjustable multiplying powers of the MR damper;

the two second amplitude-frequency relationship comprises:

$$\left(\frac{\eta_1 \rho_1 \omega_{10}^p a \cos\left(\frac{p\pi}{2}\right) e^{-i\omega_{10}\tau}}{2} - \omega_{10} a \sigma + \frac{3\mu_1 a^3}{8}\right)^2 + \left(\frac{\eta_1 \rho_1 \omega_{10}^p a \sin\left(\frac{p\pi}{2}\right) e^{-i\omega_{10}\tau}}{2} + \frac{\alpha_1 \omega_{10} a}{2} + \frac{\beta_1 \omega_{10} a}{2}\right)^2 = \frac{F_0^2}{4}$$

In this application, the corresponding time domain curve and amplitude frequency curve of the vibration damping system in the operating state can be obtained by simulation.

Figure 14:
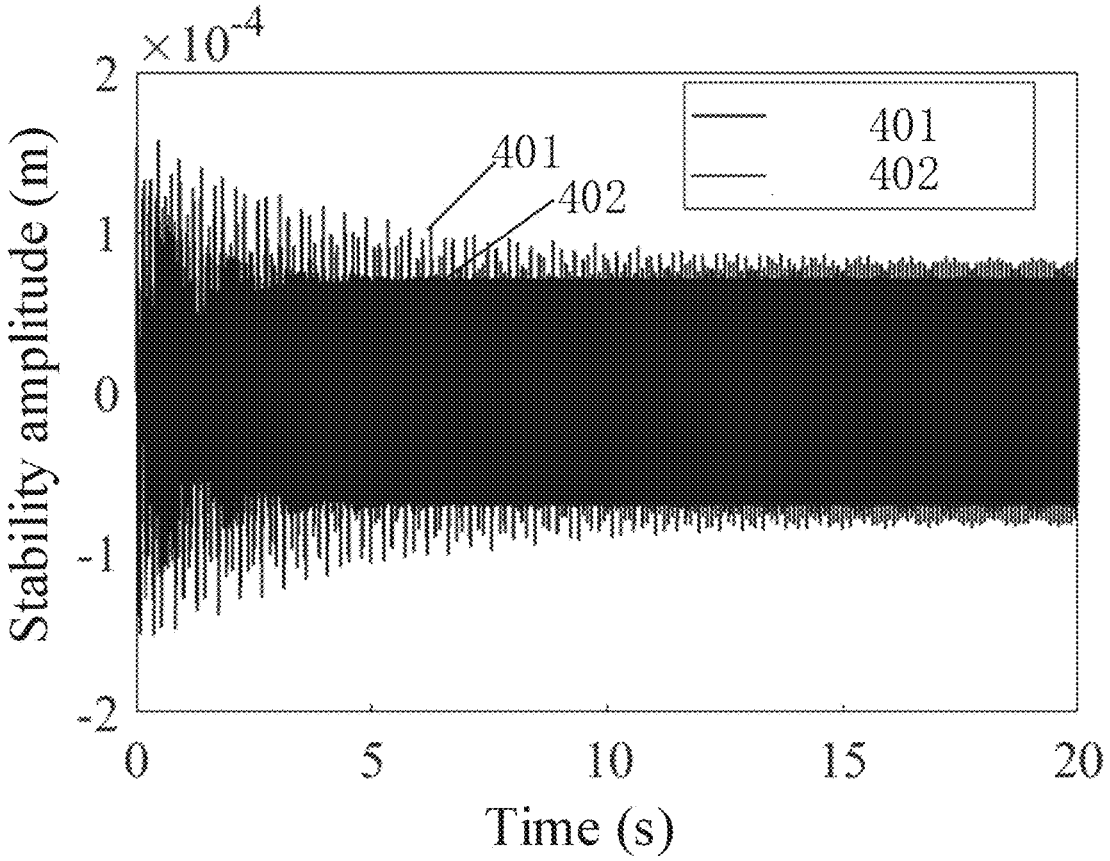
FIG. 14 is a diagram of two time domain curves corresponding to a working state and a non working state of the rolling mill roller assembly vibration suppression system of an embodiment of the present application.

FIG. 14 is a diagram of two time domain curves corresponding to a working state and a non working state of the rolling mill roller assembly vibration suppression system of an embodiment of the present application. As shown in FIG. 14, it can be seen that the stability amplitude of the vibration displacement of the rolling roller gear is 8.610 before the vibration damping device is in the non-working state-5, the m (curve 401) decreases to 6.510 when the vibration damping device is added with the vibration damping device-5 And m (curve 402). It can be determined that the vibration reducing device reduces the vibration amplitude of the rolling roll system.

Figure 15:
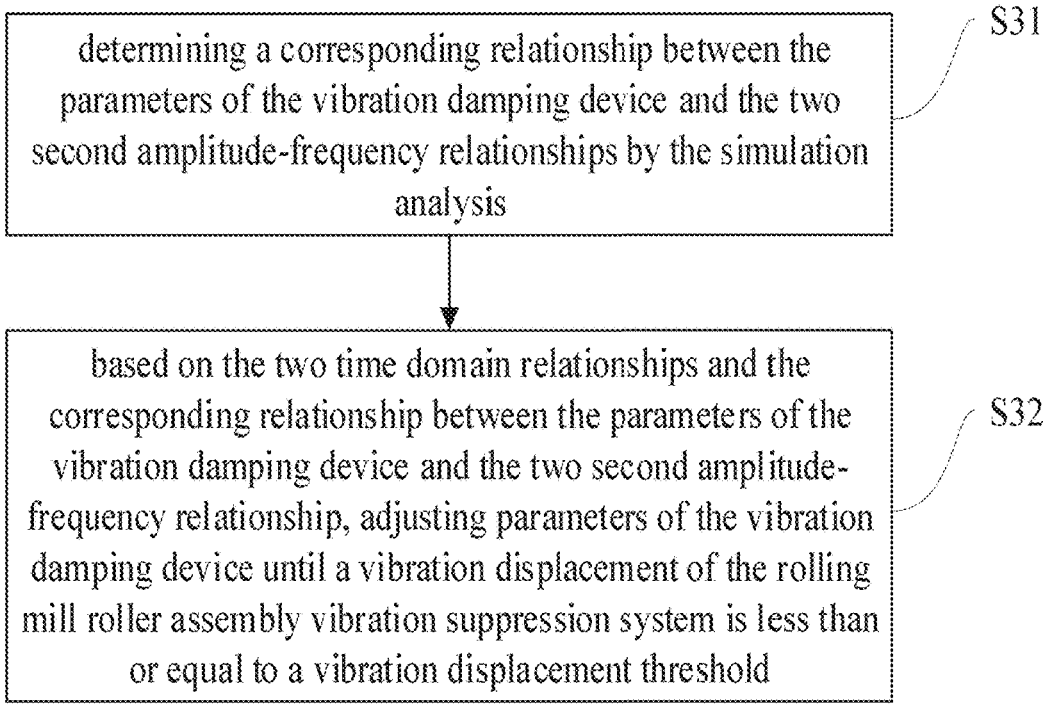
FIG. 15 is a fourth detailed flowchart of the vibration suppression method of S3 of FIG. 9.

As shown in FIG. 15, S3 includes:

S31: determining a corresponding relationship between the parameters of the vibration damping device and the two second amplitude-frequency relationships by the simulation analysis.

S32: based on the two time domain relationships and the corresponding relationship between the parameters of the vibration damping device and the two second amplitude-frequency relationship, adjusting parameters of the vibration damping device until a vibration displacement of the rolling mill roller assembly vibration suppression system is less than or equal to a vibration displacement threshold.

Wherein the parameters of the vibration damping device includes an initial damping force and damping force adjustable multiplying powers of the MR damper of the vibration damping device, a damping force and an inherent time delay of the passive damper of the damping device.

Figure 16:
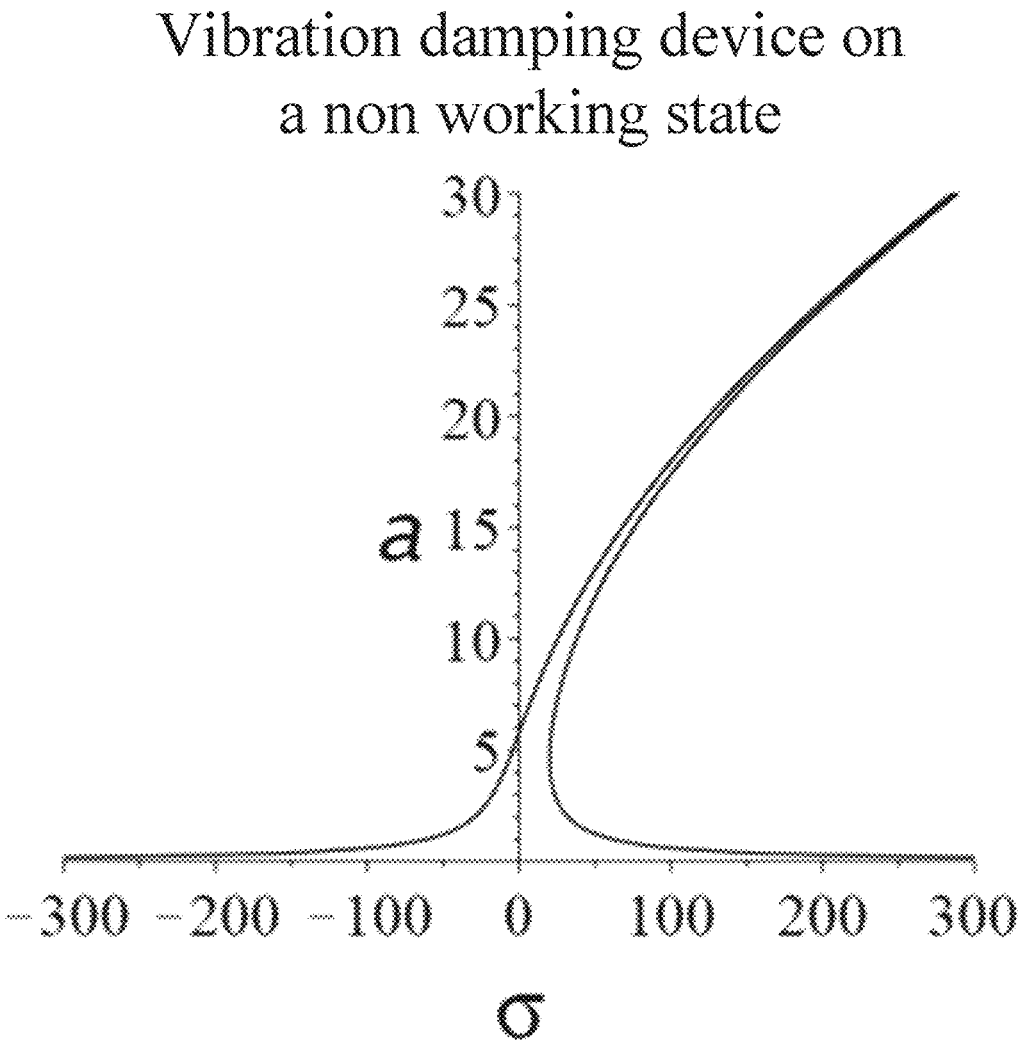
FIG. 16 is a diagram of a amplitude-frequency curve corresponding to a non working state of the rolling mill roller assembly vibration suppression system of an embodiment of the present application.
Figure 17:
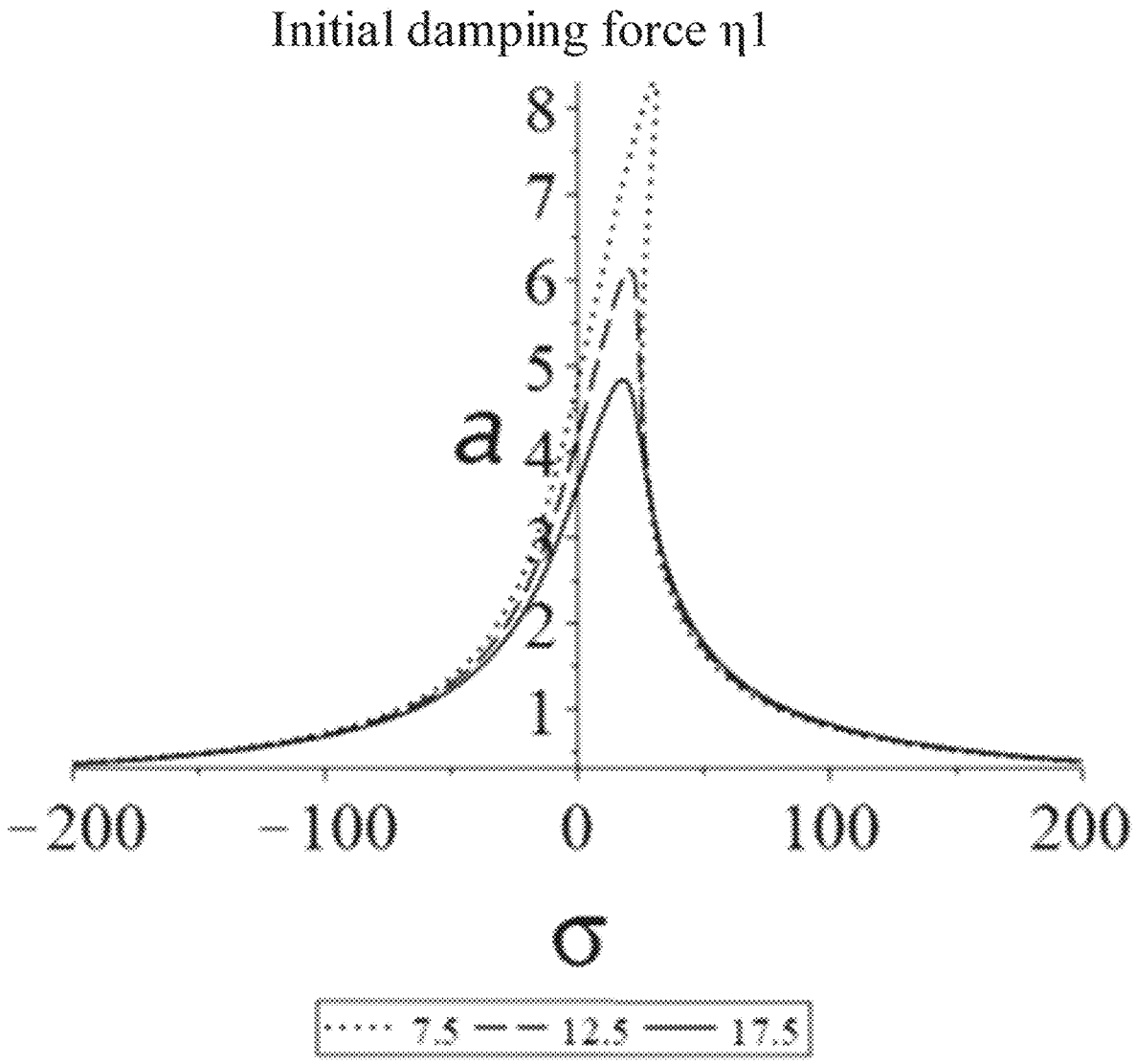
FIG. 17 is a schematic diagram of the corresponding relationship between the initial damping force and a amplitude-frequency characteristics of the rolling mill roller assembly vibration suppression system of an embodiment of the present application.
Figure 18:
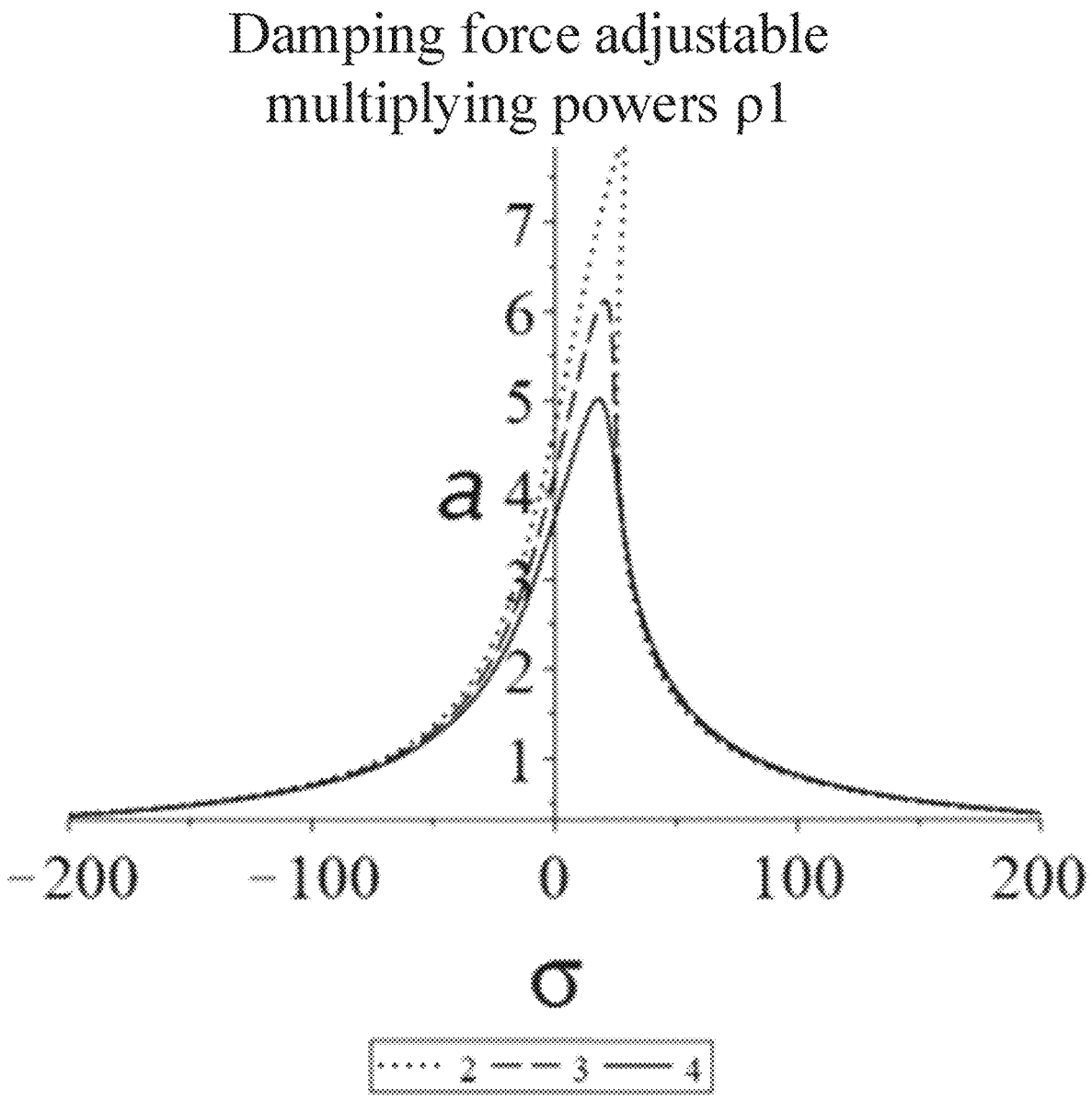
FIG. 18 is a schematic diagram of the corresponding relationship between the damping force adjustable multiplying powers and the vibration amplitude-frequency characteristics of the rolling mill roller assembly of an embodiment of the present application.
Figure 19:
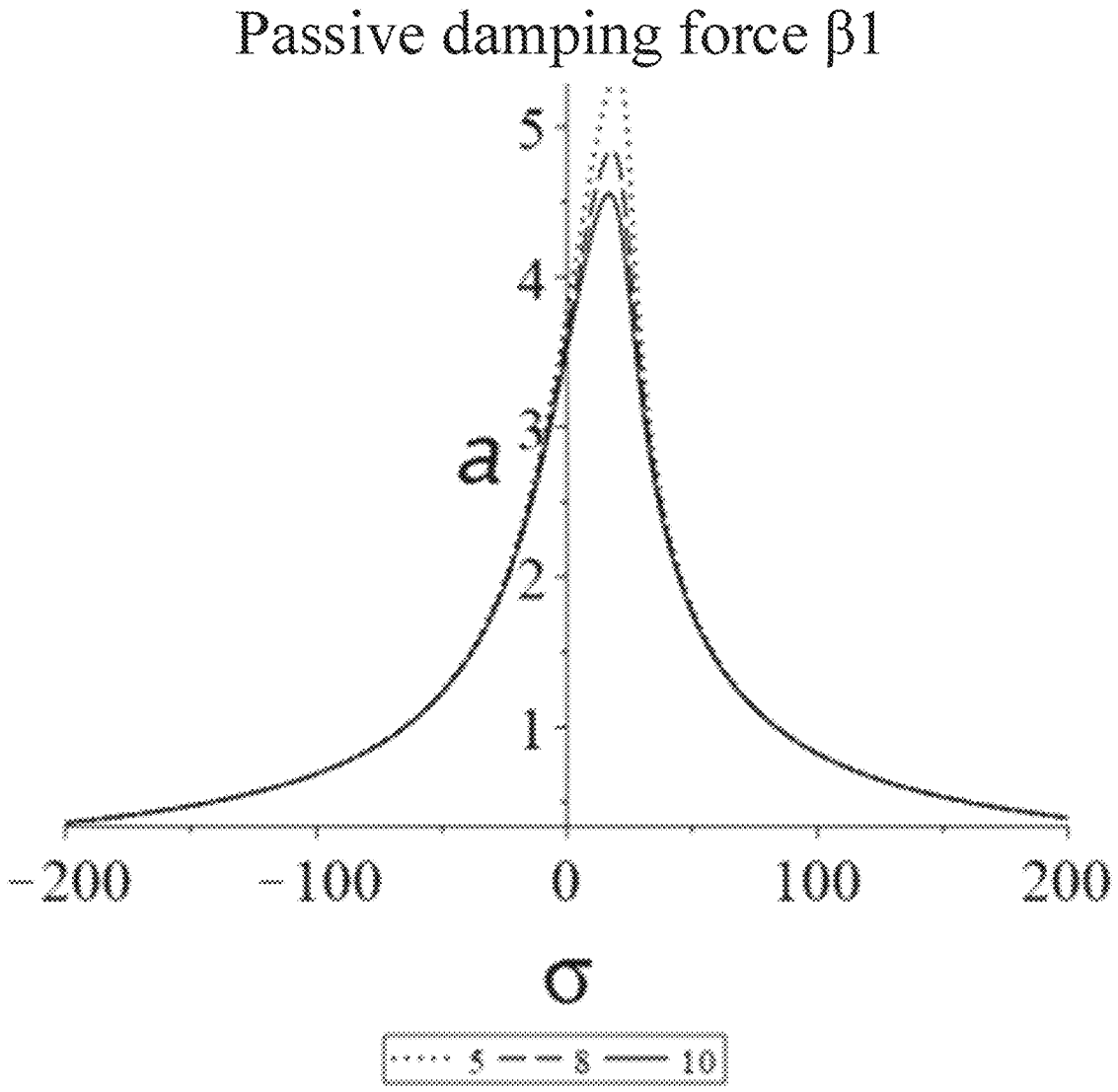
FIG. 19 is a schematic diagram of a corresponding relationship between the damping force of a pair of passive dampers and a vibration amplitude-frequency characteristics of the rolling mill roller assembly of an embodiment of the present application.
Figure 20:
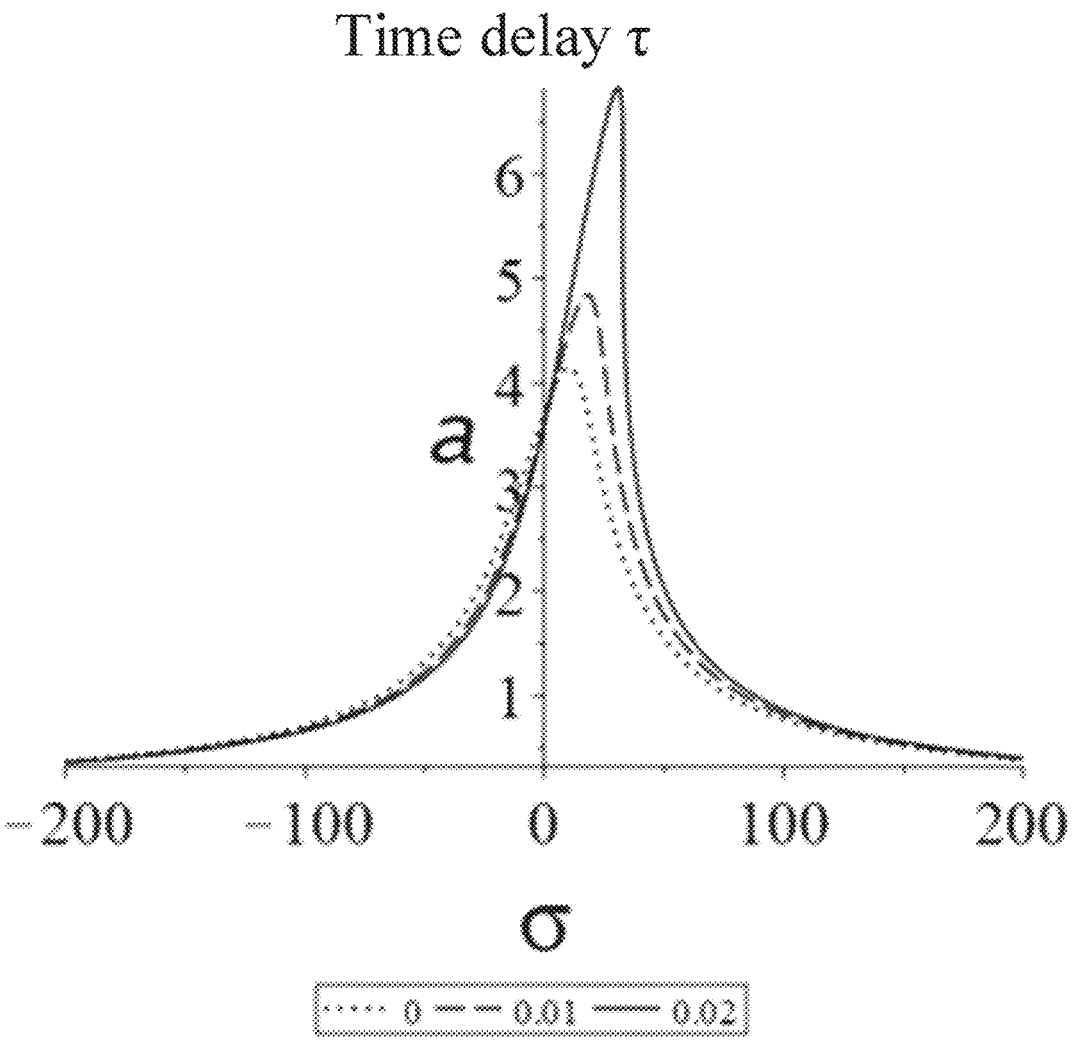
FIG. 20 is an schematic diagram of the corresponding relationship of an inherent time delay of a pair of passive dampers and a vibration amplitude frequency characteristics of the rolling mill roller assembly of an embodiment of the present application.

FIG. 16 is a diagram of a amplitude-frequency curve corresponding to a non working state of the rolling mill roller assembly vibration suppression system of an embodiment of the present application, FIG. 17 is a schematic diagram of the corresponding relationship between the initial damping force and a amplitude-frequency characteristics of the rolling mill roller assembly vibration suppression system of an embodiment of the present application, FIG. 18 is a schematic diagram of the corresponding relationship between the damping force adjustable multiplying powers and the vibration amplitude-frequency characteristics of the rolling mill roller assembly of an embodiment of the present application, FIG. 19 is a schematic diagram of a corresponding relationship between the damping force of a pair of passive dampers and a vibration amplitude-frequency characteristics of the rolling mill roller assembly of an embodiment of the present application, FIG. 20 is a schematic diagram of the corresponding relationship of an inherent time delay of a pair of passive dampers and a vibration amplitude frequency characteristics of the rolling mill roller assembly of an embodiment of the present application, The horizontal axis of Figure FIG. 16-Figure FIG. 20 shows the frequency, The vertical axis represents the magnitude amplitude.

Comparing FIGS. 16 to 20, it is clearly that the height of the amplitude and frequency curve and the bending curve of the mill roller system is reduced, that is, the vibration reducing device affects the effectiveness of the system stability to illustrate the vibration control of the mill roller system.

Refers to FIGS. 17 to 18, the change of the damping force of the MR damper and the passive damper changes the height of the amplitude frequency characteristic curve, i. e. the passive damping force affects the vibration amplitude of the system; in the active control, the inherent time delay cannot be ignored, which shows from FIG. 20 that the change changes the height of the amplitude frequency characteristic curve, that is, the inherent time delay affects the vibration amplitude of the system and increases the vibration amplitude value.

That is, it is possible to determine the corresponding relationship between the relevant parameters of the vibration damping device and the second frequency-amplitude relationship, including: the height of the amplitude frequency curve of the rolling roller and the change of the inherent time delay changes the height of the amplitude frequency characteristic curve, that is, the inherent time delay affects the vibration amplitude of the system and increases the vibration amplitude value.

In this application, the preset vibration displacement threshold can be adjusted according to the actual application scenario, obtaining the mutual relationship between the vibration damping device and the corresponding relationship between the corresponding parameters and the second frequency amplitude relationship, adjusting the initial damping of the adjustable multiplier, and reducing the vibration displacement of the rolling mill system, thus improving the stability of the rolling mill system, thus providing a new solution for the stability control of the rolling mill system.

In summary, the vibration suppression method provided by the embodiment of the present application obtains the first frequency amplitude relationship of the rolling gear vibration suppression system in the vibration amplitude process and adjusts the relevant parameter until the vibration displacement of the rolling gear is less than or equal to the preset vibration displacement threshold value. The present application obtains the interactive relationship between the vibration damping device and the rolling mill roll system through the time domain characteristics and amplitude frequency characteristics, appropriately adjusts the relevant parameters of the vibration reducing device to reduce the high frequency band, low frequency band and irregular vibration displacement of the rolling mill, provides a new solution for the stability control of the rolling mill, and ensures the reliability and stability of the vibration suppression of the rolling mill.

A rolling roller vibration suppression method based on vibration damping device provided in this application can be implemented in the vibration suppression system as shown in FIGS. 1-8, and will not be repeated in order to avoid repetition.

Figure 21:
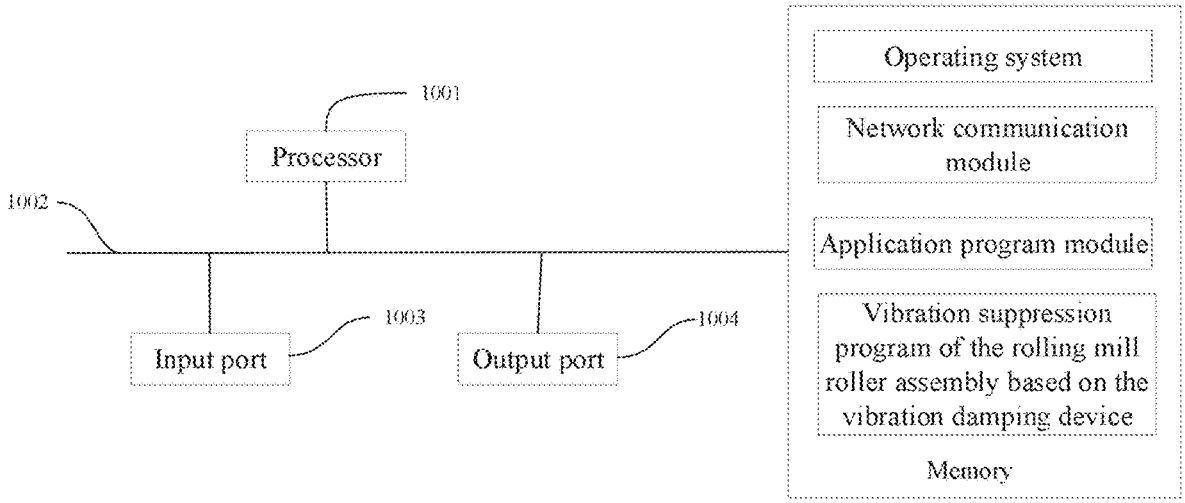
FIG. 21 is another schematic diagram of the controlling equipment of the vibration suppression system of the rolling mill roller assembly based on the vibration damping device of an embodiment of the present application.

As shown in FIG. 21, the controlling equipment also includes: a processor 1001 (such as Central Processing Unit, CPU), a communication bus 1002, an input port 1003, an output port 1004, and a memory 1005. Among them, the communication bus 1002 is used to achieve connection communication between these components; the input port 1003 is used for data input; and the output port 1004 is used for data output, and the memory 1005 can be high-speed RAM memory or non volatile memory, such as disk memory, non-transitory computer-readable storage medium. Optionally, memory 1005 is a storage device independent of the aforementioned processor 1001.

The memory 1005, as a non-volatile readable storage medium, may include an operating system, network communication module, application program module, and a vibration suppression program of the rolling mill roller assembly based on the vibration damping device. The network communication module is mainly used to connect to servers and communicate data with them; And processor 1001 is used to call the program to process the method stored in memory 1005, and execute all steps of vibration suppression method of the rolling mill roller assembly based on the vibration damping device mentioned above.

Although the present application is described in combination with specific features and its embodiments, various modifications and combinations may be made without departing from the spirit and scope of the present application. Accordingly, the specification and drawings are merely an exemplary illustration of the application as defined in the attached claims and are deemed to have covered any and all modifications, changes, combinations or equivalent within the scope of the application. Clearly, persons skilled in the art may make various changes and modifications to this application without departing from the spirit and scope of the present application. Thus, if these modifications and variations of the present application are within the scope of the present claims and their equivalent technology, the present application is also intended to include these modifications and variants.

The invention claimed is:

1. A vibration suppression method of a rolling mill roller assembly based on a vibration damping device, wherein, comprising following steps:

S1: obtaining a first amplitude-frequency relationship during a vibration process of a rolling mill roller assembly vibration suppression system;

S2: based on the first amplitude-frequency relationship, determining two time domain relationships and two second amplitude-frequency relationships by a simulation analysis, wherein the two time domain relationships are corresponding to a working state and a non working state of the rolling mill roller assembly vibration suppression system, and the two second amplitude-frequency relationships are corresponding to the working state and the non working state of the rolling mill roller assembly vibration suppression system;

S3: based on the two time domain relationships and two second amplitude-frequency relationships, adjusting parameters of the vibration damping device until a vibration displacement of the rolling mill roller assembly vibration suppression system is less than or equal to a vibration displacement threshold;

wherein, S1 comprises following steps:

S11: establishing a simplified model corresponding to the rolling mill roller assembly vibration suppression system; wherein the vibration damping device is a kind of passive vibration damping device that connects a magnetorheological (MR) damper to an end of the rolling mill of the rolling mill roller assembly through sleeves and a bearing, and then connects a mass block to the IR damper through an elastic element and a damping element, after the vibration damping device is installed on the rolling mill roller assembly, a freedom system with two degrees is formed;

S12: calculating a corresponding relationship of the freedom system with two degrees of the rolling mill roller assembly vibration suppression system based on the simplified model;

S13: performing a data processing to the freedom system with two degrees by a multiscale method, to obtain the first amplitude-frequency relationship;

wherein, S12 comprises following steps:

S121: obtaining an equivalent mass of the lower rolling mill roller assembly, an equivalent mass of the mass block of a passive damper corresponding to the vibration damping device, and an equivalent damping between the lower rolling mill roller assembly and a rolling piece, and an equivalent linear stiffness, and an equivalent nonlinear stiffness, and an equivalent damping and an equivalent stiffness of the lower rolling mill roller assembly and the passive damper;

S122: calculating a corresponding relationship of the freedom system with two degrees of the rolling mill roller assembly vibration suppression system based on the equivalent mass of a lower rolling mill roller assembly, the equivalent mass of the mass block of the passive damper, and the equivalent damping between the lower rolling mill roller assembly and the rolling piece, and the equivalent linear stiffness, and the equivalent nonlinear stiffness, and the equivalent damping and the equivalent stiffness of the lower rolling mill roller assembly and the passive damper;

wherein, S3 comprises following steps:

S31: determining a corresponding relationship between the parameters of the vibration damping device and the two second amplitude-frequency relationships by the simulation analysis;

S32: based on the two time domain relationships and the corresponding relationship between the parameters of the vibration damping device and the two second amplitude-frequency relationship, adjusting the parameters of the vibration damping device until the vibration displacement of the rolling mill roller assembly vibration suppression system is less than or equal to the vibration displacement threshold; wherein the parameters of the vibration damping device comprises an initial damping force and damping force adjustable multiplying powers of the MR damper of the vibration damping device, a damping force and an inherent time delay of the passive damper of the damping device.

2. The vibration suppression method of the rolling mill roller assembly based on the vibration damping device according to claim 1, wherein the corresponding relationship of the freedom system with two degrees comprises:

$$\begin{cases} m_1\ddot{x}_1 + c_1\dot{x}_1 + c_2(\dot{x}_1 - \dot{x}_2) + k_1x_1 + k_1'x_1^3 + k_2(x_1 - x_2) + P\cdot D^p(x_{1\tau} - x_{2\tau}) - F\cos(\omega t) = 0 \\ m_2\ddot{x}_2 - c_2(\dot{x}_1 - \dot{x}_2) + c_3x_2 - k_2(x_1 - x_2) + k_3x_2 - P\cdot D^p(x_{1\tau} - x_{2\tau}) = 0 \end{cases};$$

wherein, $m_1$ is the equivalent mass of the lower rolling mill roller assembly, $m_2$ is the equivalent mass of the mass block of the passive damper, and $c_1$ is the equivalent damping between the lower rolling mill roller assembly and the rolling piece, and $k_1$ is the equivalent linear stiffness, and $k_1'$ is the equivalent nonlinear stiffness, and $c_2$ is the equivalent damping of the lower rolling mill roller assembly and the passive damper, and $k_2$ is the equivalent stiffness of the lower rolling mill roller assembly and the passive damper, $F\cos(\omega t)$ is a periodic external excitation that the rolling mill is subjected; $P\cdot D^p(x_{1\tau} - x_{2\tau})$ is an equivalent damping force of the MR damper of vibration the damping device between the lower rolling mill roller assembly and the passive damper; $c_3$ is an equivalent damping between the passive damper and a rolling mill stand of the lower rolling mill roller assembly, and $k_3$ is the equivalent stiffness of the passive damper and the rolling mill stand of the lower rolling mill roller assembly.

3. The vibration suppression method of the rolling mill roller assembly based on the vibration damping device according to claim 2, wherein S13 comprises the following steps:

S131: simplifying the corresponding relationship of the freedom system with two degrees to obtain a simplified corresponding relationship of the freedom system with two degrees;

S132: based on the initial damping force and the damping force adjustable multiplying powers, determining simplified equivalent damping force expressions of the MR damper;

S133: based on the simplified equivalent damping force expressions of the MR damper and corresponding relationship of a current freedom system with two degrees, performing the data processing to the freedom system with two degrees by a multiscale method, to obtain the first amplitude-frequency relationship.

4. The vibration suppression method of the rolling mill roller assembly based on the vibration damping device according to claim 3, wherein the corresponding relationship of the simplified freedom system with two degrees comprises:

$$\begin{cases} \ddot{x}_1 + \omega_{10}^2x_1 = -\alpha_1\dot{x}_1 - \beta_1(\dot{x}_1 - \dot{x}_2) + \gamma_1x_2 - \mu_1x_1^3 - F_1D^p(x_{1\tau} - x_{2\tau}) + F_0\cos(\omega t) \\ \ddot{x}_2 + \omega_{20}^2x_2 = \beta_2(\dot{x}_1 - 2\dot{x}_2) + \gamma_2x_1 + F_2D^p(x_{1\tau} - x_{2\tau}) \end{cases};$$

wherein $$\omega_{10} = \sqrt{\frac{k_1 + k_2}{m_1}},\ \omega_{20} = \sqrt{\frac{2k_2}{m_2}},\ \alpha_1 = \frac{c_1}{m_1},\ \beta_1 = \frac{c_2}{m_1},\ \beta_2 = \frac{c_2}{m_2},$$

$$\gamma_1 = \frac{k_2}{m_1},\ \gamma_2 = \frac{k_2}{m_2},\ \mu_1 = \frac{k_1'}{m_1},\ F_1 = \frac{P}{m_1},\ F_2 = \frac{P}{m_2},\ F_0 = \frac{F}{m_1};$$

the simplified equivalent damping force expressions of the MR damper comprises:

$$\begin{cases} F_1\cdot D^p(x_{2\tau}) = \eta_1\rho_1D^p(x_{1\tau} - x_{2\tau}) \\ F_2\cdot D^p(x_{2\tau}) = \eta_2\rho_2D^p(x_{1\tau} - x_{2\tau}) \end{cases};$$

wherein, $\eta_1$ and $\eta_2$ are initial damping force coefficients of the MR damper, $\rho_1$ and $\rho_2$ are damping force adjustable multiplying powers of the MR damper;

the two second amplitude-frequency relationship comprises:

$$\left(\frac{\eta_1\rho_1\omega_{10}^p a\cos\left(\frac{p\pi}{2}\right)e^{-i\omega_{10}\tau}}{2}-\omega_{10}a\sigma+\frac{3\mu_1 a^3}{8}\right)^2+\left(\frac{\eta_1\rho_1\omega_{10}^p a\sin\left(\frac{p\pi}{2}\right)e^{-i\omega_{10}\tau}}{2}+\frac{\alpha_1\omega_{10}a}{2}+\frac{\beta_1\omega_{10}a}{2}\right)^2=\frac{F_0^2}{4}.$$

5. A vibration suppression system of a rolling mill roller assembly based on a vibration damping device, wherein, the vibration suppression system comprising:

a controlling equipment, the vibration damping device being connected to the controlling equipment, and a rolling mill roller assembly being connected to the vibration damping device;

wherein the controlling equipment is configured to obtain first amplitude-frequency relationship during a vibration process of the rolling mill roller assembly vibration suppression system; and the controlling equipment is configured to determine two time domain relationships and two second amplitude-frequency relationships by a simulation analysis, based on the first amplitude-frequency relationship; and the controlling equipment is configured to adjust parameters of the vibration damping device until a vibration displacement of the rolling mill roller assembly vibration suppression system is less than or equal to a vibration displacement threshold, based on the two time domain relationships and two second amplitude-frequency relationships;

wherein the vibration damping device comprises a mounting bearing, a magnetorheological (MR) damper, a passive damper, a supporting rod and a magnetic sucker;

wherein the rolling mill roller assembly comprises a rolling mill stand and a rolling mill roller, wherein the rolling mill stand is connected with the magnetic sucker, the rolling mill roller is connected with the supporting rod; and wherein the controlling equipment is connected with the MR damper and the rolling mill roller; and wherein the controlling equipment comprises a plurality of acceleration sensors, a first calculation member, and a second calculation member, and a controller; wherein two of the acceleration sensors are connected with each other, and the controller is connected with the MR damper;

wherein the MR damper is configured to determine the vibration displacement of the rolling mill roller through the acceleration sensors; and wherein the MR damper and the passive damper is configured to absorb part of the vibration energy of the rolling mill roller.

* * * * *